US012241339B2

(12) United States Patent
Gunnerud et al.

(10) Patent No.: US 12,241,339 B2
(45) Date of Patent: Mar. 4, 2025

(54) METHOD OF MODELLING A PRODUCTION WELL

(71) Applicant: SOLUTION SEEKER AS, Oslo (NO)

(72) Inventors: Vidar Gunnerud, Oslo (NO); Anders Sandnes, Oslo (NO); Bjarne Grimstad, Oslo (NO)

(73) Assignee: SOLUTION SEEKER AS, Oslo (NO)

( * ) Notice: Subject to any disclaimer, the term of this patent is extended or adjusted under 35 U.S.C. 154(b) by 82 days.

(21) Appl. No.: 17/995,797

(22) PCT Filed: Apr. 8, 2021

(86) PCT No.: PCT/NO2021/050097
§ 371 (c)(1),
(2) Date: Oct. 7, 2022

(87) PCT Pub. No.: WO2021/206565
PCT Pub. Date: Oct. 14, 2021

(65) Prior Publication Data

US 2023/0167717 A1 Jun. 1, 2023

(30) Foreign Application Priority Data

Apr. 8, 2020 (GB) ..... 2005239
Oct. 26, 2020 (GB) ..... 2016983

(51) Int. Cl.
*E21B 43/00* (2006.01)

(52) U.S. Cl.
CPC ..... *E21B 43/00* (2013.01); *E21B 2200/20* (2020.05)

(58) Field of Classification Search
CPC ..... E21B 43/00; E21B 43/16; E21B 43/30; E21B 2200/20
See application file for complete search history.

(56) References Cited

U.S. PATENT DOCUMENTS 8,380,475 B2 * 2/2013 Slupphaug ..... E21B 43/34 703/10
8,417,496 B2 * 4/2013 Main ..... E21B 43/00 703/10

(Continued)

FOREIGN PATENT DOCUMENTS

WO WO2014/170425 A2 10/2014
WO WO2016/178666 A1 11/2016
WO WO2017/077095 A1 5/2017
WO WO2018/202796 A1 11/2018
WO WO2019/110851 A1 6/2019

OTHER PUBLICATIONS

Aitokhuehi, I. "Real-Time Optimization of Smart Wells" Thesis, Stanford U. (2004) (Year: 2004).*

(Continued)

*Primary Examiner* — Jay Hann
(74) *Attorney, Agent, or Firm* — Heslin Rothenberg Farley & Mesiti P.C.; George S. Blasiak, Esq.

(57) ABSTRACT

A method of modelling one of a plurality of hydrocarbon production wells, wherein each production well is associated with at least one control point in a flow path associated therewith. The method comprises: (i) generating a first model capable of describing for any one of the first plurality of production wells a relationship between flow parameters, well parameters and/or an associated status of the at least one control point, wherein the first model is parameterised by a set of first parameters representative of properties common to all of the first plurality of production wells. The model can be applied to estimate well parameters, flow parameters and/or the status of control points. In addition, the resultant models can be used to optimise production of the production well.

32 Claims, 4 Drawing Sheets

(56) References Cited

U.S. PATENT DOCUMENTS

| | | | | |
|---|---|---|---|---|
| 9,708,899 | B2 * | 7/2017 | Prange | E21B 44/00 |
| 9,946,234 | B2 * | 4/2018 | Foss | G05B 13/041 |
| 10,353,112 | B2 * | 7/2019 | Hansen | G01V 9/005 |
| 11,053,789 | B2 * | 7/2021 | Maher | E21B 43/006 |
| 11,674,366 | B2 * | 6/2023 | Trehan | E21B 43/128 703/10 |
| 2018/0320504 | A1 * | 11/2018 | Gunnerud | E21B 43/122 |

OTHER PUBLICATIONS

Jansen, J., et al. "Model-based control of multiphase flow in subsurface oil reservoirs" J. Process Control, vol. 18, pp. 846-855 ( 2008) (Year: 2008).*

Lerlertpakdee, P., et al. "Efficient Production Optimization With Flow-Network Models" Society of Petroleum Engineers J., SPE-170241-PA, vol. 19, pp. 1083-1095 (2014) available from <https://onepetro.org/SJ/article/19/06/1083/205413/Efficient-Production-Optimization-With-Flow> (Year: 2014).*

Al-Anazi, A., et al. "Innovative Production Optimization Technique for Smart Well Completions Using Real-Time Nodal Analysis Applications" Society of Petroleum Engineers, SPE-189198-MS (2017) (Year: 2017).*

Search Report under Section 17(5); Intellectual Property Office; mailing date Jul. 10, 2020; Application No. GB2005239.5; 4 pages.

Combined Search and Examination Report under Sections 17 and 18(3); Intellectual Property Office; mailing date Dec. 24, 2020; Application No. GB2016983.5; 6 pages.

International Search Report and the Written Opinion of the International Searching Authority, or the Declaration; International Searching Authority; Jun. 9, 2020; PCT/NO2021/050097; filing date Apr. 8, 2021; 7 pages.

* cited by examiner

METHOD OF MODELLING A PRODUCTION WELL

CROSS REFERENCE TO RELATED APPLICATIONS

This application is a national stage filing under section 371 of International Application No. PCT/NO2021/050097 filed on Apr. 8, 2021, and published on Oct. 14, 2021 as WO2021/206565 A1 and claims priority United Kingdom Application No. 2005239.5 filed on Apr. 8, 2020 and United Kingdom Application No. 2016983.5 filed on Oct. 26, 2020. The entire contents of WO2021/206565 A1 are hereby incorporated herein by reference.

The present invention relates to methods of modelling a hydrocarbon production well (e.g. a gas and/or oil production well). The present invention further extends to corresponding computer systems and computer programme products. The resulting models can be applied to estimate and/or predict well parameters, flow parameters and/or the status of control points such as flow rates, well health indicators, compositional makeup of the produced fluid etc., in a real-time setting and to make future predictions of production well behaviour. In addition, the resultant models can be used to optimise production.

In the oil and gas industry, it is of particular interest to obtain accurate models of the behaviour of production wells. The behaviours of production wells can be difficult to measure and/or model accurately, particularly mechanistically, and in many cases may vary unpredictably. Further, the availability of critical process components changes with time and thereby capacities vary equivalently. It is thus difficult to optimise production settings for such hydrocarbon production wells, and correspondingly the production networks in which they are situated. Simulations and models can be used in an attempt to predict the behaviours of production wells and flow networks to changes in process parameters such as flows, pressures, mixing of different constituents and so on.

Well flow, a primary well characteristic of interest, is traditionally modelled from conservation laws for mass, momentum, and energy. Such modelling can be considered as mechanistic modelling of the well—i.e. based on actual, true physics of the well flow. Equation (1) below sets out a traditional mechanistic model for use in estimating total flow rates. Such a model results from an assumption of conservation of momentum and energy. Mass conservation is also implicitly assumed for steady-state flow, which can be derived as an average (mean) of the dominant dynamic behaviour of the production well during a settled period of production.

$$Q=f(u,p,t,\eta,\xi) \tag{1}$$

In the above model of equation (1), Q represents the total flow rate from the production well, p represents the pressures of the flow from the well (collected as a single term), t represents temperatures of the flow (collected as a single term), $\eta$ represent volumetric (or mass) fraction of the constituents of the produced fluid as compared to total flow, $\xi$ represents the model parameters that are indicative of the physical properties of the system (e.g. fluid properties, geometric properties and external factors), and u represents the other explanatory variables in the system including control variables (e.g. position of a choke valve in the flow path from the production well) and measurements of the state of the production system.

In theory $\xi$ can be an exhaustive list of parameters which specify all properties of the system relevant to the modelling of the flow rates. For example, the $\xi$ parameters can describe nano/micro properties of the system (e.g. individual particle flow paths in the production system) as well as macro properties of the system (e.g. choke sizing, pipe diameter, fluid viscosities etc.).

Modelling with such a parameter set is impractical however for two primary reasons. Firstly, not all of these parameters can be measured for any given system. Secondly, the large number of parameters, particularly the large number of unobservable parameters, result in an intractable model.

Therefore, in practice the parameters $\xi$ are decomposed into two different sets of parameters: a first set, $\alpha$, that represent the parameters of the production system that can be observed and a second set, $\beta$, representative of the parameters of the system that cannot be observed. The first set of $\alpha$ parameters may include, e.g., pipe roughness within the production system, the density of the oil in standard conditions, etc. Using the observable parameters, a simplified mechanistic model, g, for the total flow of the production system can be produced as shown in equation (2).

$$Q=g(u,p,t,\eta,\alpha) \tag{2}$$

The physics of the model g is simplified as compared to the true model f since not all parameters of the production system/well are accounted for (i.e. parameters $\beta$ are ignored). Such a simplified mechanistic model will therefore not give a 'true' picture of the production system.

In the past, modellers have tried to find a close approximation of g (termed $\tilde{g}$) via extensive mechanistic modelling. Candidates for approximation model $\tilde{g}$ are compared on test data from real wells or experimental test loops. In practice, it is necessary to approximate model g (i.e. produce a model g) for only certain parameter configurations $\lambda$ (i.e. for production systems/wells sharing common physical properties and/or characteristics) as otherwise the modelling would be too complex to be practically useful. An exemplary parameter configuration $\lambda$ that may be used as a limitation on the approximate model $\tilde{g}$ is a configuration $\lambda$ in which the produced flow regime is likely to be a slugging flow. By limiting the approximation model $\tilde{g}$ to only certain parameter configurations $\lambda$, the modelling of the production system/well can be significantly simplified, and data from a diverse range of wells/production systems falling within the shared parameter configuration $\lambda$ can be used to produce the approximate model $\tilde{g}$. Modelling within the shared parameter configuration $\lambda$ is illustrated by equation (3) below.

$$Q=\tilde{g}(u,p,t,\eta,\alpha:\alpha\in\lambda), \tag{3}$$

The model illustrated in equation (3) is generated by testing the approximation model $\tilde{g}$ on data from individual production wells, and fine tuning the observable parameters $\alpha$ of the model such that the model $\tilde{g}$ is better calibrated to modelling the specific well of interest. Once the approximation model has been calibrated as such, the model can be used to estimate further flow rates of the production well.

In the more recent past, data driven modelling, as opposed to the more traditional mechanistic modelling as described above, has been implemented in the modelling of liquid and gas flow rate from a single production well or single flow network. An example of such a data driven modelling technique as is known in the art is described in WO 2019/110851.

The models produced in these prior art data driven techniques are generated and trained based on data from the single well or single flow network to be modelled. Thus, as the model is based on real life data (as opposed to an approximated mechanistic model that ignores certain unobservable parameters of the production well) the model can, in theory, give a truer reflection of the behaviour production than the approximation, mechanistic models discussed above.

That being said, data driven implemented models to date have limited applicability.

For instance, data driven models to date are only particularly suited for modelling the single production well/flow network from which the data used in the generation of the model has been collected. As such, prior art data driven models have limited applicability with regard to the number of production systems/wells they can model successfully and accurately.

In addition, the amount of data gathered for a single well/flow network will be limited. That is, only data collected throughout the operational life of that single well/flow network is available for modelling. It will be appreciated that an increased amount of data upon which the model is based will result in a more robust model, and equally a less robust model will be generated when less data is available for its generation. Thus, prior art models typically have limited robustness.

Further, prior art models produced will be based only on historical data, recorded during a previous state/states of the well/network. This data will typically not be indicative of the present/future state of the production well. This is particularly in view of the fact that the drainage of the reservoir (to which the production well is connected) over time will result in changing behaviour of the production well. Such changes in the reservoir resulting in a change of behaviour of the production well can be termed the "reservoir effect" on the production well.

Many of the limitations in the data driven modelling techniques used to date are not typically shared by the approximate mechanistic modelling techniques as discussed above. For instance, approximate mechanistic models are generated on the basis of a set of observable physical parameters, a, that are (or should be) common to each of the wells in the shared parameter configuration λ under which the mechanistic model is generated. That is to say, the mechanistic approximation models have been generated to account for the behaviours of a plurality of different diverse wells (albeit under a specific parameter configuration A) and are therefore typically more robust, can realistically model a plurality of different wells/flow networks and can also better account for the reservoir effect for this reason.

Improvements in data driven models are thus desired.

According to a first aspect of the invention there is provided a method of modelling one of a first plurality of hydrocarbon production wells, each production well being associated with at least one control point in a flow path associated therewith, the method comprising: (i) generating a first model capable of describing for any one of the first plurality of production wells a relationship between flow parameters, well parameters and/or an associated status of the at least one control point, wherein the first model is parameterised by a set of first parameters representative of properties common to all of the first plurality production wells.

Since the model is parameterised by a first set of parameters representative of properties common to all of the plurality of production wells, the model can be used to model any of the plurality of the production wells relatively accurately and successfully. This is in contrast to prior art data driven models, which as above are typically only suited for modelling a single production network or well (i.e. the production network/well for which the model has been designed and from which the data has been derived for its generation and training). For instance, in relation to the modelling techniques disclosed in WO 2019/110851, there are no shared parameters between the different well models. The parameters within each of the models are well specific and there is no representation in these models of properties common to each of the wells within a plurality. Thus, the models produced in WO 2019/110851 are only properly suited for modelling the specific well for which they have been produced for, and have poor applicability more generally to a range of wells. This is in contrast to the first model of the first aspect of the invention, which has applicability across the plurality of production wells.

The first model also has improved robustness by virtue of the first set of parameters which are shared and common across all of the first plurality of wells. The generation and optional training of the model as discussed in further detail below can be based on a larger data set gathered from across a larger array of wells. Prior art methods generate their model for the specific well to be modelled and train said model based on data from only the well to be modelled. Thus biases within the model, both resulting from the nature of the model itself and from the data used to train the prior art model, more highly impact on the model produced, and thus produce inaccuracies in the resultant model and/or poor applicability to wells other than that which it has been designed to model.

The set of first parameters that are common to each of the wells can be considered as analogous to the A parameter configuration as discussed above in relation to the mechanistic modelling techniques. That is, the first parameters are representative of a shared configuration of each of the plurality of production wells (i.e. are indicative of some physical properties and/or characteristics that are common to each of the production wells). Thus, as noted above, in a similar fashion to the mechanistic models the model of the first aspect can suitably model any one of a plurality of production wells since it accounts for behaviours and traits common to each of the wells in the first plurality.

However, the number of parameters in the first set of parameters is significantly higher than the number of parameters used in the mechanistic models. Mechanistic models will often comprise anywhere between 1 and 4 parameters. In the present invention, the data driven based modelling used enables the first set of parameters to optionally comprise upwards of 1000 parameters, optionally in the region of 10 000-1 000 000. Sufficient computing power may allow for a greater number of parameters than even this however. It will be appreciated that this greater number of parameters may allow for improved and more accurate modelling.

The first set of parameters that are described as being common, or shared, may mean that a given parameter is identical in the first model for each well within the plurality. This is known as hard sharing. Alternatively, a given parameter in the first model may be almost identical (i.e. almost equal) for different wells within the first plurality and still considered to be shared. That is, instead of having a given parameter that is identical for each well, the given parameter may be slightly different between wells within the first model. In this case, the difference between parameters is penalised to account for their non-identity. This is known as soft-sharing. This hard or soft sharing may equally apply with respect to the parameters of the further first model(s), the flow composition model(s), the prediction model(s) etc. as described in further detail below.

The method of the first aspect may comprise the further steps of (ii) generating at least one further first model capable of describing for any one of a further, different plurality of production wells a relationship between flow parameters, well parameters, and/or an associated status of the at least one control point, wherein the at least one further first model is parameterised by a further set of first parameters representative of properties common to all of the further plurality of production wells; and (iii) combining the first model with the at least one further first model to form a combined model capable of describing for any one of the wells in the first plurality and the at least one further plurality of production wells a relationship between flow parameters, well parameters and/or associated status of the at least one control point to which it relates.

The at least one further first model, in itself, shares many of the same advantages as the first model. That is, it allows for a successful and accurate modelling of any of the wells in the further, different plurality of production wells since it contains a further set of first parameters that are representative of the behaviours and characteristics common to each of the further, different plurality of production wells.

Therefore, the combination of the first model and the at least one further first model forms a combined model with even further greater applicability and/or increased accuracy of modelling. The greater applicability to a larger range of wells of this combined model is most notably achieved where at some of the wells in the further, different plurality of wells are not contained in the first plurality. Thus, the overall combined model is better suited for modelling a greater number of wells than either of the first or further first models in and of themselves.

Greater accuracy is in particular achieved where there is at least some overlap between the wells in the further, different plurality of wells and the first plurality of wells. For those overlapping wells the accuracy of modelling provided by the combined model is increased since the combined model is derived from two separate models based on different sets of first parameters reflecting the behaviours of those 'overlapping wells', thus providing a greater overall picture of the behaviours of these wells.

The method of the first aspect may comprise generating a plurality of further first models, each further first model capable of describing for a respective further different plurality of production wells a relationship between flow parameters, well parameters, and/or an associated status of the at least one control point, wherein each further first model is parameterised by a set of first parameters representative of properties common to the respective further plurality of production wells; and combining the first model with the plurality of further first models to form a combined model capable of describing for any one of the wells in both the first plurality and each of the at least one further pluralities of production wells a relationship between flow parameters, well parameters and/or associated status of the at least one control point to which it relates.

The plurality of further first models expands on the advantages obtainable by the single further first model discussed above. That is, a plurality of further first models can provide increased applicability and improved accuracy of modelling. Thus improved modelling of a greater number of wells and/or more accurate modelling of wells can be achieved.

As alluded to above, at least some of the production wells within the, or each, further plurality of productions wells may be in the first plurality of production wells. Additionally and/or alternatively, at least of the production wells within one, or more, of the further plurality of production wells may be in another of the further plurality of production wells. For these overlapping wells in particular, the combined model may provide an improved accuracy of modelling.

All of the productions wells within the, at least one, several or each further plurality of production wells may be in the first plurality of production wells, and the first plurality of production wells may additionally include further production wells. As such, the, at least one, several or each further plurality of production wells may be considered as a subset of the first plurality of production wells. Thus, the further, first model(s) can be seen to model and account for behaviours or characteristics of wells which may not necessarily be shared across all of the first plurality, but may be shared across a smaller, subset of the first plurality.

For example, the first plurality of wells may comprise wells spread across a number of different assets or hydrocarbon reservoirs. The first model can therefore aptly model any behaviours, characteristics or traits of the wells that are commonly held for wells across each of these different assets/reservoirs. However, some behaviours/traits of the wells may not be held commonly for wells across all of these different assets/reservoirs. For instance, some behaviours may be asset specific. Therefore, a further first model may be created to model the behaviours of the models at only one specific asset and, once combined with the first model, the combined model can accurately model those wells from the specific reservoir more accurately than either of the first model or the further first model could in and of themselves. This is because the combined model can account for those behaviours and traits held commonly across several reservoirs/assets and those which are specific to the reservoir at which the subset of wells are located.

The above is merely an example of how the first plurality and the, at least one, several or each further, different plurality of wells can interrelate to one another. Further divisions/subdivisions/relationships of the first plurality and the, at least one, several, or each further, different plurality are envisioned. For instance, as a further development of the above example, a further first model may be introduced that models only a subset of wells at the specific reservoir. Alternatively, the first plurality of wells may be all the wells from a specific reservoir, and the, or each, further, different plurality of production wells may be a subset of the wells at that specific reservoir. As a further alternative, the first plurality of wells may be wells across a variety of different assets experiencing some common dynamic behaviour, e.g. slugging flow. The, or each, further different plurality of production wells may then be wells from a specific reservoir or site and demonstrating this particular dynamic behaviour.

The skilled person would appreciate that there are very many further ways in which the first plurality of production wells, and the, at least one, several or each further different plurality of production wells can be divided/sub-divided. The important takeaway is that when the, or each, further different plurality of production wells relates to a subset of the first plurality of wells, the, at least one, several or each further first model can be introduced into the combined model to account for more specific behaviours and traits whilst the first model can account for more generic traits and behaviours. Thus, an overall improved accuracy of modelling can be achieved.

At least some of the production wells within the, at least one, several or each further plurality of productions wells may not be included in the first plurality of production wells.

Thus, the first plurality and the, at least one, several or each further plurality of productions wells may be completely independent from one another, having no overlap with respect to their wells. Alternatively, there may only be a partial overlap between the first and the, at least one, several or each further first plurality of wells. In either scenario, the combined model produced is based on a greater number of wells than either the first model or the, at least one, several or each further first model in and of themselves. Consequently, the combined model has greater applicability and will have improved accuracy for at least those partly overlapping wells, if any such wells exist.

The method may comprise generating a second model that is capable of describing a relationship between flow parameters, well parameters and/or an associated status of at least one control point for only one production well, wherein the second model is parameterised by a set of second parameters that are representative of properties that are specific to the production well to which it relates; combining the second model with the first model, and optionally the, at least one, several or each further first model to form a combined model that is capable of describing a relationship between flow parameters, well parameters and/or an associated status of the at least one control point for only the one production well.

The first model generated in the method of the first aspect is advantageous since it allows for a robust modelling of a production well that is not overly reliant on the past properties and behaviours of that well as discussed above. The further first model(s) are similarly advantageous For this same reason however, whilst robust, the first model/further first model(s) is/are not best placed to characterise and model the idiosyncratic behaviours that are specific to a specific production well to be modelled. That is to say, whilst certain behaviours, characteristics and traits will be shared across a plurality of production wells (and are represented in the first (or further first) set of parameters), other behaviours, characteristics and traits will be unique to a particular production well. Thus, inferences cannot be usefully and/or accurately drawn for these well specific behaviours/traits/characteristics based on knowledge from other wells.

Therefore, to better account for the physical properties, behaviours and characteristics that are specific to the well that is to be modelled, the modelling of the well may incorporate a second model being specific to one of the production wells to be modelled and which describes behaviours that are idiosyncratic to that well by virtue of the set of second parameters. Each set of second parameters is reflective of behaviours, characteristics and traits unique to the production well to which it relates, and as such the second model is capable of describing well-specific relationships and behaviours for that production well.

As an alternative understanding, since the first model (or further first model(s)) describes those behaviours common to each of the plurality of production wells (or further plurality of production well(s)), the first model (further first model(s)) may be understood to capture the middle/average well within the respective plurality of production wells. Additionally, since the second model describes those behaviours specific to the production well to which it relates, the second model can be considered to capture the differences in behaviour that specific well has from the middle/average well within the respective plurality of production wells. Consequently, the combination of the first (and/or further first model(s)) with the second model allows for an accurate modelling of the specific well because the first model can be tailored by the second model to give an accurate representation of that specific well.

The relationship described by the second model between flow parameters, well parameters and/or an associated status of the at least one control point for the production well to which it relates may not have a tangible, real world physical equivalent. That is to say, it may not be possible to equate the relationship described by the second model to a real world, physical relationship. However, irrespective of whether the relationship described by the second model can be considered to correspond to a real world physical relationship or not, the second model remains descriptive of some (perhaps undefinable) relationship between flow parameters, well parameters and/or an associated status of the at least on control point for the production well to which it relates.

The set of second parameters may comprise between 1-20 parameters, for instance 10 parameters.

The one well to which the second model relates may be comprised within the first plurality of production wells, the, several or each further plurality of production wells, and/or any of the pluralities of wells referred to below. As such, the combined model may be tailored for specifically modelling one of the wells within the first and/or the, several or each further plurality of production wells, or within one of the various pluralities of wells mentioned below.

The one well to which the second model relates may not be comprised within the first plurality of production wells, the, several or each, further plurality of production wells, and/or any of the pluralities of wells referred to below. In this scenario, the generic behaviours and traits for the first plurality of wells and/or the, or each, further plurality of production wells can be assumed to hold true for a well not included in first plurality of production wells and/or in the, or each, further plurality of production wells. This assumption can be useful where no useful model is available for the generic behaviours/traits to which the second model relates. This assumption can also be a relatively safe assumption to make, particularly where there a large number of diverse wells within the first plurality or the, several or each, further first plurality, or the pluralities of wells referred to below and/or where the well to which the second model relates shares similar behaviours and traits to wells within the first plurality and/or the, several or each, further first plurality, or the pluralities of wells referred to below.

The method may comprise generating a plurality of second models, each second model capable of describing a relationship between flow parameters, well parameters and/or an associated status of the at least one control point for a respective production well, each second model being parameterised by a set of second parameters that are representative of properties that are specific to the production well to which it relates; and combining each second model with the first model, and optionally the, several or each, further first model (or indeed any of the various models referred to below) to form combined models that are each capable of describing a relationship between flow parameters, well parameters and/or an associated status of the at least one control point for the respective production well to which it relates.

Thus, combined models that suitably account for the specific and generic properties of a plurality of different, individual wells can be provided.

Optionally, there may be a second model generated for every well discussed above and below.

The plurality of second models may be comprised within a second model structure. Where it is desired to model for a specific, or only a select few, well(s) the second model structure can be contracted down by input of a signal such that only the second model(s) relating to the production well(s) of interest remain in the second model structure. This can be achieved for instance by setting the second parameters in those second models relating to other wells not of interest within the plurality to zero. As such, upon input of the well-specific signal, the second model structure is made capable of describing a relationship between flow parameters, well parameters and/or an associated status of the at least one control point for only that/those production well(s) associated with the well-specific signal.

The concept of using a well-specific signal to maintain only the/those second model(s) in the second model structure that are of interest can be understood as a 'hot well coding'. That is, the second model structure is enforced to be specifically capable of modelling 'hot' well(s) (i.e. wells of interest) by virtue of the input of the well-specific signal. This is advantageous as it provides a relatively computationally cheap manner in tailoring the second model structure, and thereby the combined model, to be specifically suited for modelling specific well(s) since the signal reduces the model to only including the second model specific to the behaviour and configuration of the well to be modelled.

The second model structure may be a second model matrix, whereby each column of the matrix represents a second model (i.e. a second model vector). As such, the input signal can be seen to select a vector (or vectors) from the second model structure for use in the subsequent steps of the method.

Once contracted (i.e. after the selection of the second model(s) of interest) the second model structure can be incorporated as part of the combined model. As such, the resulting combined model is specifically tailored to modelling the/those well(s) of interest. By virtue of this combination of the second model structure and the first (and/or further first), well-generic, model(s), an overall improved, combined model is generated that avails from the advantages of both first, (further first) and second models. That is to say, the resultant model is robust (i.e. not heavily influenced by historic states specific to the well to be modelled), accounts well for the reservoir-effect, and can account for the idiosyncratic behaviour of the production well-being modelled.

As will be appreciated, the second model structure resulting from input of the well specific signal may result in a structure comprising one or a plurality of second models. In scenarios where a plurality of second models remain in the tailored second model structure, the incorporation of the second model structure as part of the combined model may comprise input of each of the plurality of second models remaining in the second model structure into respective copies of the combined/first model.

The well-specific signal may be a binary vector. Alternatively, any signal capable of achieving the second model 'selection' as noted above may suitably be used as the well-specific signal.

Each second model may consist of the set of second parameters that are representative of properties that are specific to its related production well. That is to say each second model may merely be the second parameters, in vector form or otherwise. The input of the well-specific signal into the second model structure may hence merely be a simple matrix multiplication, particularly in cases where the well-specific vector is a binary vector.

The incorporation of the second model/the second models into the first/combined model may comprise inputting data relating to flow parameters, well parameters and/or an associated status of the at least one control point from the associated production well(s) into the second model(s). Second model output(s) may then be generated that are specific to that/those production well(s). Each second model output can be seen as a unique fingerprint to the/those second model(s) and the/those production well(s) to which the second model(s) relate. This/these output(s) may then be used as the input(s) to the first/combined model such that the first/combined model is specifically capable of describing the behaviours/traits/characteristics of the/those production well(s) of interest. That is to say, after said input the first/combined model is (as is always the case) capable of accounting for both those behaviours/traits/characteristics that are common to each of the wells in the first plurality (and optionally the, several or each further plurality) and, by virtue of the output of the second model, is capable of accounting for the well specific behaviours.

The method may comprise generating a flow composition model that is capable of describing a relationship between the flow composition of the fluid produced from any one of a second plurality of production wells and the flow parameters, well parameters, an associated status of the at least one control point, and/or time, wherein the flow composition model is parameterised by a first set of flow composition parameters that are representative of the flow composition common to all of the second plurality production wells; and combining the flow composition model with the first model, and optionally the, several or each further first model and/or the, several or each, second model to form a combined model that is capable of describing a relationship between flow parameters, wells parameters, an associated status of the a least one control point, and/or time, for any one of the wells within the second plurality and the first plurality of production wells, and optionally the, several or each further plurality of production wells and/or the, or each, well upon which the second model(s) is/are based.

The flow composition model is specifically capable of describing behaviours and traits that are common to the flow composition of the fluid produced from each of the second plurality of wells. As will be appreciated by those skilled in the art, an accountability of flow composition is of particular importance in the modelling of production wells since it directly impacts on numerous other traits and behaviours, and is a key variable in the overall production performance. Thus, the generation of the flow composition model and its combination as part of the combined model allows for the flow composition to be properly accounted for in the modelling of the production wells.

As is the case for the first and the, several or each further first model discussed above, the flow composition model is generated such that it is capable of describing behaviours and traits that are common to the flow composition from a plurality of wells (i.e. the second plurality of wells). This is achieved by virtue of the first set of flow composition parameters which are descriptive of behaviours and traits common to each of the wells within the second plurality. Thus, the flow composition model shares similar advantages to the first model and the, or each, further first model in respect of applicability and accuracy in respect of modelling flow composition.

The first set of flow composition parameters may comprise between 0-1000 parameters, optionally 0-100. It is also possible for there to be more than 1000 parameters in the first set of flow composition parameters.

At least some of production wells within the second plurality of production wells may be comprised within the first plurality of production wells, the further plurality of production wells, several of the further pluralities of production wells and/or each further plurality of production wells. For these overlapping wells in particular, the combined model may provide an improved accuracy of modelling. This is in particular because it is these wells for which the flow composition behaviour and other generic behaviours are accounted for in the combined model.

All of the productions wells within the second plurality of production wells may be comprised in the first plurality of production wells, and/or the, several or each, further plurality of production wells.

For example, the wells in the second plurality of wells may be identical to the wells in the first plurality of production wells, and/or the, several or each further plurality of production wells. Thus, the flow composition model can allow for a particularly accurate modelling of all of the wells within the first plurality and/or the, several or each further plurality of production wells as it can accurately described the flow composition behaviours common to each of these wells.

Alternatively, the first plurality of production wells and/or the, several or each, further plurality of production wells may additionally include further production wells. As such, the second plurality of production wells may be considered as a subset of the first plurality of production wells and/or of the, several or each further plurality of production wells. Thus, the flow composition model can be seen to model and account for behaviours of the flow composition that are shared across a smaller, subset of wells and that are not necessarily shared by each of the first plurality and/or the, several or each further plurality.

As such, and similar to what was discussed above in connection with the further first model(s), since the second plurality of production wells relates to a subset of the first plurality of wells, and/or the, several or each further first plurality of wells, the flow composition model can be introduced into the combined model to account for flow composition behaviours and traits that are more specific to a certain number of wells, whilst the first model and/or the, several or each, further first model can account for more generic traits and behaviours of the wells. Thus, an overall improved accuracy of modelling can be achieved.

The relationship between the second plurality of production wells and the first plurality of production wells and/or the, several or each, further different plurality of production wells may correspond to the relationships set out above with respect to the first plurality of productions wells and the, or each, further plurality of production wells.

At least some of the production wells within the second plurality of production wells may not be included in the first plurality of production wells, and/or the, several or each further plurality of production wells. Thus, the second plurality, the first plurality and the, several or each further plurality of productions wells may be completely independent from one another, having no overlap with respect to their wells. Alternatively, there may only be a partial overlap between the second plurality and the first and the, several or each, further first plurality of production wells. In either scenario, the combined model produced is based on a greater number of wells than any of the individual models in and of themselves. Consequently, the combined model has greater applicability and will have improved accuracy for at least those partly overlapping wells, if any such wells exist.

The method of the first aspect may comprise generating a plurality of flow composition models (each of which may be correspondent to the flow composition model discussed above). Each flow composition model may be capable of describing a relationship between the flow composition of the fluid produced from any one of a respective second plurality of production wells and the flow parameters, well parameters, an associated status of the at least one control point, and/or time, wherein each flow composition model is parameterised by a first set of flow composition parameters that are representative of the flow composition common to all of the respective second plurality production wells to which it relates. The method may further comprise combining each flow composition model with the first model, and optionally the further first model, several further first models or each further first model and/or the, or each, second model to form a combined model that is capable of describing a relationship between flow parameters, wells parameters, an associated status of the a least one control point, and/or time, for any one of the wells within any one of the second plurality of production wells and the first plurality of production wells, and optionally the, several or each further plurality of production wells and/or the, or each, well upon which the second model(s) is/are based.

The method of the first aspect may comprise generating a well specific flow composition model that is capable of describing a relationship between the flow composition of the fluid produced from only one production well and flow parameters, well parameters, an associated status of the at least one control point, and/or time, wherein the well specific flow composition model is parameterised by a second set of flow composition parameters that are representative of the flow composition specific to the production well to which it relates; combining the well specific flow composition model with the first model and optionally the, several, or each further first model, the, several or each second model, and/or the, several or each well composition model to form a combined model that is capable of describing a relationship between flow parameters, well parameters, an associated status of the at least one control point, and/or time for only the one production well.

The well specific flow composition model shares similarities with the second model in that it models behaviours specific to only one well (in this case flow composition behaviours). Thus, the combination of the well specific flow composition model into the combined model results in advantages corresponding to those achieved by virtue of the combination of the second model into the combined model. That is, the combination of the well specific flow composition model allows for flow composition behaviours specific to the well to which it relates to be accounted for in its modelling and which may not be accurately accounted by any of the other models comprised within the combined model.

The second set of flow composition parameters may comprise between 0-10 parameters, and optionally up to 100 parameters or more.

The one well to which the well specific flow composition model relates may be comprised within the first plurality of production wells, the, several, or each, further plurality of production wells, the, several or each, second plurality of production wells, and/or any of the pluralities of wells discussed below. Similar to what was discussed above in connection with the second model, a greater accuracy of modelling can thus be achieved for this one well when comprised in any of the pluralities set out above.

The one well to which the well specific flow composition model relates may not be comprised within the first plurality of production wells, the, or each, further plurality of production wells, the, or each, second plurality of production wells, and/or any of the further pluralities of wells referred to below. Thus, assumptions can be drawn across from the generic behaviours of any of these pluralities of wells and applied for the well to which the well specific flow composition model relates, whilst the well specific composition model can account for the flow composition traits that are unique to that well.

The one well to which the well specific model relates may be the same as the one well to which the, or at least one of the, second model(s) relate(s). Where there is a correspondence in wells, and there is a combination of the well-specific model with a second model relating to the same well, an improved accuracy of modelling for this well can be achieved since specific behaviours of this well model, both as accounted for in the second model and as accounted for in the well-specific model, are better reflected in the overall combined model.

The method may comprise generating a plurality of well specific flow composition models, each corresponding to the well specific flow model described above but relating to a different, respective well. Each well specific flow composition model may be capable of describing a relationship between the flow composition of the fluid produced from only one, respective well and flow parameters, well parameters, an associated status of the at least one control point, and/or time, each well specific model being parameterised by a second set of flow composition parameters that are representative of the flow composition that is specific to the only one, respective production well to which it relates. The method may further comprises combining each well specific flow composition model with the first model, and optionally the, several or each further first model, the, several or each second model and/or the, several or each flow composition model to form combined models that are each capable of describing a relationship between flow parameters, wells parameters, an associated status of the at least one control point, and/or time, for each respective well.

Thus, combined models that suitably account for the specific flow composition behaviours of a plurality of different, individual wells can be provided.

Optionally, there may be a well specific flow composition model generated for every well referred to above and below.

The plurality of well specific flow composition models may be comprised within a well specific flow composition model structure. This structure may correspond closely to the second model structure as set out above. Thus, the well specific flow composition model structure may avail from corresponding functionality and features that the second model structure can as set out above.

In addition to be being able to describe relationships between flow parameters, well parameters and/or the status of the at least one control point, the flow composition model(s) and the well specific flow composition model(s) are also able to describe relationships with respect to time. That is, these models can describe how the development of time might impact on the development of the flow composition as represented in the flow parameters, well parameters and/or the status of at least one control point. Similarly, these models can describe how the development of flow parameters, well parameters and/or the status of at least one control point resulting from the flow composition is related to time. Thus, the flow composition model(s) and the well specific flow composition model(s) can allow for interpolations and extrapolations in time, hence providing a description of flow composition at instances in time where no data may be available (e.g. a non-recorded past state or future state). This allows for modelling and estimations with regard to a production well to be made in the future, along with times in the past where perhaps inadequate data for modelling is otherwise available.

The method may comprise generating a prediction model, the prediction model capable of predicting for any one of a third plurality of production wells a change in a flow parameter, well parameter and/or a status of the at least one control point based on a hypothetical change in the status of the at least one control point, a hypothetical change in a flow parameter and/or a hypothetical change in a well parameter, wherein the prediction model is parameterised by a set of prediction parameters that are representative of properties that are common to the third plurality of production wells; and combining the prediction model with the first model, and optionally the, several or each, further first model, the, several or each second model, the, several or each flow composition model, and/or the, several or each well specific flow composition model to form a combined model that is capable of predicting a flow parameter, a well parameter and/or the status of the at least one control point resulting from a hypothetical change in the status of the at least one control point, the hypothetical change in a flow parameter, and/or the hypothetical change in the well parameter for any one of the wells within the third plurality of production wells and the first plurality of production wells, and optionally the, several or each, further plurality of production wells, the, several or each well upon which the second model(s) is/are based, the, several or each second plurality of production wells and/or the, several or each well upon which the well specific composition model(s) is/are based.

The prediction model describes how a hypothetical change (i.e. a proposed or theoretical change) in the status of the at least one control point, a well parameter and/or a flow parameter impacts on a flow parameter, well parameter and/or a status of the at least one control point for any one of the wells within the third plurality of production wells. Thus, proposed or theoretical predictions and/or developments can be determined by virtue of the incorporation of the prediction model within the combined model. As will be described below in further detail, this allows for the combined model to be used to determine an optimised state for a production well (i.e. one in which production is optimised).

The set of prediction parameters may comprise between 1000-1,000,000 parameters. Typically there may be approximately 100 000 parameters comprised within the prediction parameters.

At least some of the production wells within the third plurality of production wells may be comprised within the first plurality of production wells, the further plurality of production wells, several or each further plurality of production wells, the second plurality of production wells, several and/or each second plurality of production wells. Where there is an overlap of wells, the prediction that is enabled by the prediction model may be made more accurate. This is for reasons corresponding to those discussed above with regard to overlapping wells in various other pluralities of wells.

All of the productions wells within the third plurality of production wells may be comprised within the first plurality of production wells, the further plurality of production wells, each or several further plurality of production wells, the second plurality of production wells, several and/or each second plurality of production wells.

For example, the wells in the third plurality of wells may be identical to the wells in the first plurality of production wells, the, several or each further plurality of production wells, and/or the, several or each second plurality of production wells. Thus, the prediction model can allow for a particularly accurate modelling of all of the wells within the first plurality, the, several or each further plurality of production wells, and/or the, several or each second plurality of wells as it can accurately describe the flow composition behaviours common to each of these wells.

The first plurality of production wells, the further plurality of production wells, several or each further plurality of production wells, the second plurality of production wells, several and/or each second plurality of production wells may additionally include further production wells not included in the third plurality of production wells. Thus, the prediction model may relate only to a subset of these wells and hence can be seen to predict for behaviours or characteristics of wells which may not necessarily be shared across all of these wells, but may be shared across a smaller, subset of these pluralities.

At least some of the production wells within the third plurality of production wells may not be included in the first plurality of production wells, the further plurality of production wells, each further plurality of production wells, the and/or each second plurality of production wells. Thus, the third plurality of production wells may be completely independent from any of the other pluralities of wells. Alternatively, there may only be a partial overlap between the third plurality of wells and any of the other pluralities of wells. In either scenario, the combined model comprising the prediction model is based on a greater number of wells than any of the individual models in and of themselves. Consequently, the combined model has greater applicability and will have improved accuracy for at least those partly overlapping wells, if any such wells exist.

The method of the first aspect may comprise generating a plurality of prediction models that are each correspondent to the prediction model discussed above. Each prediction model may be capable of predicting for any one of a respective third plurality of production wells a change in a flow parameter, a well parameter and/or the status of at least one control point based on a hypothetical change in the status of the at least one control point, a hypothetical change in a well parameter and/or a hypothetical change in a flow parameter, wherein each prediction model is parameterised by a set of prediction parameters that are representative of properties that are common to each respective third plurality of production wells. The method may comprise combining each prediction model with the first model, and optionally the, or each, further first model, the, or each, second model, the, or each, flow composition model, and/or the, or each, well specific flow composition model to form a combined model that is capable of predicting a flow parameter, a well parameter and/or a status of the at least one control point resulting from a hypothetical change in the status of the at least one control point, the hypothetical change in a well parameter and/or the hypothetical change in a flow parameter for any one of the wells within any one of the third plurality of production wells and the first plurality of production wells, and optionally the, or each, further plurality of production wells, the, or each, well upon which the second model(s) is/are based, the, or each, second plurality of production wells and/or the, or each, well upon which the well specific composition model(s) is/are based.

The plurality of prediction models expands on the advantages obtainable by the single prediction model discussed above. That is, a plurality of prediction models can provide increased applicability and accuracy of prediction. Thus prediction for a greater number of wells and/or more accurate predictions for wells can be achieved.

The method may comprise generating a well-specific prediction model, the well-specific prediction model capable of predicting for only one production well a change in a flow parameter, a well parameter and/or the status of the at least one control point based on a hypothetical change in the status of at the least one control point, a hypothetical change in a well parameter and/or a hypothetical change in a flow parameter, wherein the well-specific prediction model is parameterised by a set of well-specific prediction parameters that are representative of properties specific to that production well; and combining the well-specific prediction model with the first model, and optionally the, several or each further first model, the, several or each second model, the, several or each flow composition model, the several or each well specific flow composition model, and/or, the, several or each prediction model to form combined models that are each capable of predicting a flow parameter, a well parameter and/or the status of the at least one control point resulting from a hypothetical change in the status of the at least one control point, the hypothetical change in a well parameter and/or the hypothetical change in a flow parameter for only the one production well.

The well-specific prediction model relates to a specific well and describes for that well how a hypothetical change (i.e. a proposed or theoretical change) in the status of the at least one control point, a flow parameter and/or a well parameter impacts on a flow parameter, well parameter and/or a status of the at least one control point. Thus, proposed or theoretical predictions and/or developments specific to the one well can be determined by virtue of the incorporation of the well specific model within the combined model. As will be described below in further detail, this allows for the combined model to be used to determine an optimised state (i.e. one in which production is optimised).

Where the well-specific prediction model differs from the (generic) prediction model is that it accounts for specific behaviours of the production well to which it relates rather than generic behaviours shared by a plurality of wells. Thus, the well specific prediction model allows for well specific predictions relevant to a specific well to be made. This difference between the prediction model and well specific prediction model can be seen to correspond to the difference between the flow composition model and well specific flow composition model as discussed above.

The set of well-specific prediction parameters may comprise between 0 to 100 parameters. For instance, there may be 1 or 10 well-specific prediction parameters.

The one well to which the well-specific prediction model relates may be comprised within the first plurality of production wells, the, several or each further plurality of production wells, the, several or each second plurality of production wells, and/or the, several or each third plurality of production wells. Similar to the discussion above in connection with the second model and the well specific flow composition model, a greater accuracy of modelling can be achieved for this one well by virtue of this overlap.

The one well to which the well-specific prediction model relates may not be comprised within the first plurality of production wells, the, or each, further plurality of production wells, the, or each, second plurality of production wells, and/or the, or each, third plurality of production wells. Thus, assumptions can be drawn across from the generic behaviours of any of these pluralities of wells and applied for the well to which the well specific prediction model relates, whilst the well specific prediction model can allow for the prediction of traits that are unique to that well.

The one well to which the well-specific prediction model relates may be the same as the one well to which the, or at least one of the second model(s) relate(s) and/or the same as the one well to which the, or at least one of the well-specific flow composition model(s) relate(s). Where there is a correspondence in wells, and there is a combination of the well-specific prediction model with the well-specific flow composition model and/or the second model relating to the same well, an improved accuracy of modelling and prediction for this well can be achieved.

The method may comprise generating a plurality of well-specific prediction models corresponding to the singular well-specific prediction model set out above. Each well-specific prediction model may be capable of predicting for only one, respective production well a change in a flow parameter, a well parameter and/or the status of the least one control point based on a hypothetical change in the status of at the least one control point, a hypothetical change in a well parameter and/or a hypothetical change in a flow parameter, wherein each well-specific prediction model is parameterised by a set of well-specific prediction parameters that are representative of properties that are specific to the production well to which it relates. The method may further comprise combining each well-specific production model with the first model, and optionally the, several or each further first model, the, several or each second model, the, several or each flow composition model, the, several or each well specific flow composition model, and/or, the, several or each prediction model to form combined model(s) that are each capable of predicting a flow parameter, a well parameter and/or the status of the at least one control point resulting from the hypothetical change in the status of the at least one control point, the hypothetical change in a well parameter and/or the hypothetical change in a flow parameter for each respective production well.

Thus, combined models that can allow for tailored predictions for a plurality of different, individual wells can be provided.

Optionally, there may be a well specific prediction model generated for every well referred to above and below.

The plurality of well specific prediction models may be comprised within a well specific prediction model structure. This structure may correspond closely to the second model structure as set out above. Thus, the well specific prediction model structure may avail from corresponding functionality and features that the second model structure optionally does as set out above.

In a further aspect of the invention, there is provided a method of predicting a flow parameter, well parameter and/or the status of the at least one control point for at least one production well, comprising: modelling to produce a combined model incorporating one, or more, prediction model(s) and/or one, or more, well specific prediction model(s) as set out above; and inputting a hypothetical change in the status of the at least one control point, a hypothetical change in a well parameter and/or a hypothetical change in a flow parameter associated with the at least one production well into the (respective) combined model and thereby obtaining a predicted flow parameter, well parameter and/or status of the at least one control point for the at least one production well.

As alluded to above, the prediction model(s) and well specific prediction model(s) generated in the method of the first aspect can thus be used, as part of their respective combined models, to allow for predictions to be made about well performance. Thus the model produced from the method of the first aspect can be used as part of the method of the second aspect to determine how the performance will or may have developed, and/or to determine how a certain change may affect performance of the well.

The prediction using the combined model may comprise inputting into the prediction model(s) and/or well-specific prediction model(s), prior to its/their combination as part of combined model, a hypothetical change in a well parameter, a flow parameter and/or the status in the at least one control point to thereby determine a change in a flow parameter, well parameter and/or a status of the at least one control point. The combination of the prediction model(s) and/or well specific prediction model(s) into the combined model may then comprise inputting the hypothetical change in a well parameter, a flow parameter and/or the status in the at least one control point along with the associated changed flow parameter, well parameter and/or status of the at least one control point into the first/combined model so as to provide the prediction. As such, prediction using the combined model may be bifurcated, whereby a first set of variables are input into the prediction model(s) and/or well-specific prediction model(s) to obtain an output, and then this output (along with the first set of variables) are input to the first/combined model to obtain the relevant prediction.

The method of the second aspect may comprise predicting a flow parameter, a well parameter and/or the status of at the least one control point for at least one hydrocarbon production well as set out above; repeating the prediction of a flow parameter, a well parameter and/or the status of at the least one control point for at least one hydrocarbon production well as set out above based on a different hypothetical change to the status of the at least one control point, a different hypothetical change to the flow parameter and/or a different hypothetical change to the well parameter; and determining the status of the at least one control point, the flow parameter and/or the well parameter which is/are optimised and thereby allow for optimised hydrocarbon production. As such, the method of the first aspect can be used to find an optimised state for the production well (e.g. a state where production rates are maximised). This optimised state can be defined by the status of the at least one control point, the well parameters and/or the flow parameters The prediction may be repeated a plurality of times based on a plurality of different hypothetical changes to the status of the at least one control point, different hypothetical changes to the flow parameter and/or different hypothetical changes to the well parameter.

An optimisation algorithm may be used to determine the status of the at least one control point, the flow parameter and/or the well parameter that results in an optimised flow parameter, well parameter and/or status of the at least one control point and thereby optimised hydrocarbon production.

The prediction and/or optimisation set out above may be used as part of a 'what-if' study to determine what effects certain changes might have on the performance of the production well and to thereby optionally allow for optimised performance to be achieved.

The models produced in the method of the first aspect may subsequently be used for providing estimations for a production well. This may be achieved by entering a state of the production well into the first/combined model produced from the method of the first aspect in order to achieve an estimation of a well characteristic for that production well.

Therefore, in another aspect of the invention, there is provided a method of estimating a flow parameter, a well parameter and/or the status of at least one control point for at least one hydrocarbon production well, the method comprising: modelling in accordance with any of the statements relating to the first aspect as set out above; and determining an estimated flow parameter, well parameter and/or status of at least one control point for the at least one hydrocarbon production well by inputting to the first model or the (respective) combined model a state of the at least one production well, the state comprising a flow parameter, a well parameter and/or an associated status of the at least one control point of the at least one production well.

Estimations are useful as they allow for determinations to be made regarding flow parameters, well parameters and the status of the at least one control point for a production well. These determinations can then be used to make inferences and assessments in connection with the production well and its performance—i.e. they allow the performance of the production well to be analysed.

The state of the at least one of the plurality of production wells used in the estimation may be a historical state, a real-time state or a future state. Future states in particular can be derived using the, or each, flow composition model and/or the, or each, well specific flow composition model as discussed above since these models can be time descriptive and thus allow for future states to be determined.

Where the estimation of this aspect and the prediction of the second aspect of the invention differ is that the estimation relates to a state of the production well that has occurred, is occurring or will occur or is likely to have occurred, likely is occurring or likely to occur. That is to say, the estimation relates to a state of the well that has been, is currently or will be should the well be left to develop on its own accord. The prediction of the second aspect relates to hypothetical changes with respect to the state of the well and thus can, and will, include states of the well that have not occurred at any time in the production well's lifetime, nor will they occur upon natural development of the well under its current state.

The estimated/predicted flow parameter, well parameter and/or the estimated status of the at least one control point may be a well health indicator, a water cut (WC) of the produced hydrocarbon fluid, a gas to oil ratio (GOR) of the produced fluid, a liquid loading risk indicator, a total produced fluid flow rate (by volume, mass or flow speed/velocity), a gas flow rate, an oil flow rate, a water flow rate, a liquid flow rate, a hydrocarbon flow rate, a carbon dioxide fluid flow rate, a hydrogen sulphide fluid flow rate, a multiphase fluid flow rate, a slug severity, an oil fraction, a gas fraction, a water fraction, a carbon dioxide fraction, a multiphase fluid fraction, a hydrogen sulphide fraction, a ratio of gas to liquid, density, viscosity, pH, productivity index (PI), BHP and wellhead pressures, rates after topside separation, separator pressure, other line pressures, flow velocities or a sand production. The estimated/predicted flow parameter, well parameter and/or the estimated status of the at least one control point may additionally and/or alternatively be any of those flow parameters, well parameters and/or a status of those control points set out below.

Estimating/predicting a gas flow rate, an oil flow rate, a water flow rate, carbon dioxide flow rate or a hydrogen sulphide flow rate may comprise modelling using the, several or each flow composition model, and/or the, several or each well specific flow composition model. Since the flow composition model(s) and/or well specific flow composition model(s) describe the flow constituents being produced from the well, these models may be required to determine constituent flow rates.

One, or more, of the model(s) may form part of a statistical approach such that a flow parameter, a well parameter and/or a status of the at least one control point output by the one, or more, model(s) is output as a probability distribution with an associated degree of uncertainty. Being able to model and account for inherent uncertainty within the models by overlaying with a statistical approach is useful since it is recognised that there is both error in the model(s) as it/they are not perfect reflections of the real world scenario it/they is/are attempting to represent, and since there are inherent errors in the data (e.g. due to recording tolerances or inaccuracies in sensors, meters controls and the like) upon which the/each model is generated upon and based. Thus the overlay of a statistical approach provides for an understanding of errors within the model.

The at least one control point may be a means/mechanism capable of applying a controlled adjustment to the respective production well, in particular an adjustment to the flow of fluid from the production well (e.g. the control point may be capable of applying an adjustment to one or more flow parameters). The adjustment may be in any suitable parameter of the fluid, such as a flow and/or pressure of the fluid. For example, suitable control points may include flow control valves, pumps, compressors, gas lift injectors, expansion devices and so on. The basic principle of the above methods is compatible with any control that can apply an adjustment within the conduit associated with each of the plurality of production wells. The adjustments need not only be in flow rate or pressure but may include other parameters, such as a level in a subsea separator and ESP pump setting.

The at least one control point may comprise at least one of: a flow control valve; a pump; a compressor; a gas lift injector; an expansion devices; a choke control valve; gas lift valve settings or rates on wells or riser pipelines; ESP (Electric submersible pump) settings, effect, speed or pressure lift; down hole branch valve settings, down hole inflow control valve settings; or topside and subsea control settings on one or more: separators, compressors, pumps, scrubbers, condensers/coolers, heaters, stripper columns, mixers, splitters, chillers.

The flow parameters may be properties/characteristics/parameters/behaviours relating to nature of the flow of the fluid, or these may be properties/characteristics/parameters/behaviours relating to the nature of the fluid itself. As such, the flow parameters may include one or more of pressures; flow rate, a gas flow rate, an oil flow rate, a water flow rate a liquid flow rate, a hydrocarbon flow rate, a multiphase flow rate, a flow rate that is the sum of one or more of any of the previous rates (by volume, mass or flow speed); an oil fraction, a gas fraction, a carbon dioxide fraction, a multiphase fluid fraction, a hydrogen sulphide fraction, temperatures, a ratio of gas to liquid, densities, viscosities, molar weights, pH, water cut (WC), productivity index (PI), Gas Oil Ratio (GOR), BHP and wellhead pressures, rates after topside separation, separator pressure, other line pressures, flow velocities or sand production. It will be appreciated that the flow parameters of interest would not necessarily include all possible flow parameters associated with a production well. Instead the flow parameters may include a selected set of flow parameters that are considered important to the performance of the production well. The flow parameters may be parameters that are impacted, either directly or indirectly, by the status of the at least one control point and/or the well parameters.

The flow parameters may be measured directly, for example by means of a pressure or temperature sensor, or alternatively they may be measured indirectly, for example by calculations based on directly measured parameters. The flow parameters may be parameters that are capable of being measured (i.e. parameters which are readily and commonly measured in connection with production wells by appropriate associated equipment) and/or flow parameters that are not capable of being measured (i.e. which have no associated recording equipment and/or those which are physically or practically difficult to measure).

The well parameters may include one or more of: depth, length, number and type of joints, inclination, cross-sectional area (e.g. diameter or radius) within/of a production well, wellbore, well branch, pipe, pipeline or sections thereof; choke valve Cv-curve; choke valve discharge hole cross-sectional area; heat transfer coefficient (U-value); coefficients of friction; material types; isolation types; skin factors; and external temperature profiles. The well parameters may additionally and/or alternatively be one or more of the 'near well' reservoir parameters. That is, the well parameters may include parameters of the reservoir to which the well is attached and which directly impact on the performance and behaviour of the well. Such near well reservoir parameters, which can be extracted from production well tests, may include: well productivity index, well skin factor, reservoir permeability, reservoir specific storage, reservoir boundaries.

The method of the first aspect may further comprising steps of: (ii) training the first, or combined, model on data relating to flow parameters, well parameters and/or an associated status of the at least one control point from at least two production wells from the first plurality of production wells; (iii) obtaining an updated set of first parameters from the training of the first model, wherein the updated set of first parameters more accurately parameterise the properties common to all of the first plurality production wells; and (iv) updating the first, or combined, model based on the updated set of first parameters, wherein the updated first model allows for a more accurate modelling of any one of the plurality of production wells.

The broad concept of training a model and its associated advantages are well understood in the field of data-driven modelling. That is, broadly, that an improved more accurate model can be achieved by virtue of the training step, in particular because parameters of the model can be refined and updated during the training so as to provide an improved accuracy of the model through better fitting to the available data.

The training step detailed above is unique and advantageous however in that the training is based on data from at least two (i.e. more than one) of the first plurality of production wells. That is, the data is based on at least two independent wells, and as such any subsequent modelling of a production well carried out is based on the first/combined model produced that has been trained at least in part on data which is independent from and not related to the well to be modelled.

In the past, the training stage of data modelling has been based only on data recorded from the single well to be modelled. The data used as the basis for training in prior art modelling techniques may have been data that solely related to the well to be modelled, or may have related to a plurality of wells including the well to be modelled (e.g. where comingled data and/or topside data is used in the training). In either case, the training data in the prior art always related to the well to be modelled. In contrast, in the context of the optional training steps of the invention, at least some of the training data will not relate to the well to be modelled, but instead will relate to a separate, independent well or wells.

This concept of generating and then training the first/combined model based on data from a plurality of different production wells can be considered to fall within the broad concept of 'transfer learning' which, by analogy, can be considered as using 'knowledge' of the behaviour of other, different and independent production wells in helping to provide an improved model for modelling a specific production well. In particular, the first/combined model in the method of the first aspect may have improved accountability of the reservoir effect by virtue of the optional transfer learning involved in its training. This is because typically the at least two production wells within the first plurality of production wells will comprise wells at various different stages in their operational lives and thus the data collected, and thereby the model produced, will be able to better account for effects of reservoir depletion that occurs during the lifetime of a well. The training of the first/combined model will also provide for improved accountability of other physical similarities between the wells in the first plurality, for instance the choke valves, the well bores, etc. The first/combined model may also have improved robustness and will be less heavily influenced by the historical data of the well to be modelled since the model is trained based on a larger data set from a plurality of different wells.

To say this another way, by training the first/combined model on data from at least a sub-set of wells in the first plurality of production wells, the parameters of the model can be updated to better reflect the true physical properties and characteristics of any one production well in the first plurality since inferences regarding the behaviour of the well (both present and future) can be made based on corresponding behaviour and states in other wells within the sub-set. As such, an updated first/combined model is obtained that is better reflective, at least on average, of the 'true' behaviours of each of the first plurality of production wells without having shortcomings resulting from the reservoir effect and/or a limited data training set.

More precisely, the generating and training the first/combined model based on data from a plurality of different production wells as discussed herein can be considered as a form of Multi-Task Learning (MTL). MTL attempts to leverage data from multiple tasks to improve model performance on all tasks where all or a subset of the tasks are assumed to be related. For instance, in the context of the current invention, modelling the flow through one well can be considered as one task. Given data from multiple wells, MTL then attempts to simultaneously model all wells. Models are formulated such that a plurality of the model parameters are shared for the wells.

To benefit from the advantages of transfer learning/MTL, the training should be based on data relating to at least two of the first plurality of production wells. However, the advantages associated with the transfer learning concept are enhanced when the training of the first/combined model is based on data relating to a greater number of wells and, optionally, all of the first plurality of production wells. A greater number of wells provides a greater amount of data on which the model can be trained, thereby providing improved robustness of the first model and better accountability of, for instance, the reservoir effect, the well bore of the well, the choke valve and other physical similarities between the wells.

As alluded to above, optionally the first plurality of production wells comprise production wells at various different stages of their operational lives. This is beneficial for the reasons discussed above (i.e. a more eclectic data set will be used as the basis of the training).

The first plurality of production wells may contain production wells that are connected to the same hydrocarbon reservoir to which the well that is to be modelled is connected. Additionally and/or alternatively, the first plurality of production wells may be connected to one or more different hydrocarbon reservoir(s) to which the well to be modelled is connected. The various different hydrocarbon reservoir(s) may be at different stages of their exploitation lifetime and/or may have varying different fluid compositions and constituents therein. For example, the first plurality of wells may be connected to a reservoir substantially comprising of oil, a reservoir substantially comprising of hydrocarbon gas, and/or a reservoir anywhere between these two extremes (e.g. a wet-gas reservoir). The reservoirs to which the first plurality of production wells may be attached may additionally and/or alternatively comprise a varying degree of water cuts within their produced fluid.

Additionally and/or alternatively, the, several or each further first plurality of production wells, the, several or each second plurality of production wells, and/or the, several or each third plurality of production wells may comprise production wells of the type as described above in connection with the first plurality of production wells.

It is beneficial for the first plurality (and indeed, any other of the pluralities) of production wells to be connected to a plurality of different hydrocarbon reservoirs since a larger and more eclectic data set can be provided, which is beneficial both for the generation of the first/combined model and for the optional training of the first model, which provides a more robust model that is better able to account for the dynamic behaviours of a production well as discussed above.

The training may comprise a plurality of iterative training steps. Each step may be based on a batch of data relating to flow parameters, well parameters and/or an associated status of the at least one control point from at least one of the first plurality of production wells. Therefore, in order to train on data from at least two of the first plurality of production wells, the batch/batches used in the iterative training must at least (whether individually or in combination) be from at least two of the first plurality of production wells.

Each, or several, of the iterative training steps may be based on a different batch of data to the other iterative training steps.

The, or at least one, batch of data, and optionally several or all batches of data, may relate to flow parameters, well parameters and/or an associated status of the at least one control point from at least two of the first plurality of production wells, and optionally more wells.

The, or each, batch of data used in the training of the model may be randomly/stochastically selected from the total data available relating to flow parameters, well parameters and/or an associated status of the at least one control point from the plurality of production wells.

The training of the first model may involve training based on data relating to every well in the first plurality of production wells. Where a batch-type approach is implemented in the steps of training, this may involve training on a plurality of batches equivalent to the number of wells in the first plurality in a scenario where each relates to flow parameters, well parameters and/or an associated status of the at least one control point from only one of the first plurality of production wells. It will be recognised that fewer iterative batch steps are required where one, or more, of the batches relate to data from two or more production wells in order to train on data from each of the first plurality of wells.

It is not however required for the training of the first/combined model to be based on data relating to every well in the plurality, the optional training only needs to be based on at least two of the wells within the first plurality of production wells.

Steps (iii) and (iv) are presented as two separate and sequential steps in the training in the method of the first aspect of the invention. However, in an implementation, steps (iii) and (iv) may be combined into a single step. That is to say, the steps of obtaining an updated set of first parameters and updating the first/combined model based on the updated set of first parameters may occur within a single stage.

Upon initial generation of the first model, it may be possible to generate a set of first parameters that accurately represent the properties common to all of the plurality of production wells. In such a scenario, it may not be necessary to change the first parameters of the first model in order for the first model to accurately model any one of the first plurality of production wells. In this eventuality, step (iii) of the training of the first/combined model may comprise obtaining a set of first parameters the same or closely comparable to those originally generated in step (i). Once confirmed that the first set of parameters resulting from step (iii) are the same or closely comparable to those originally generated in step (i), the update to the first parameters in step (iv) may simply be considered as a maintenance of the first parameters as those which were originally generated.

The training of the first/combined model may involve training based on data relating to every well in the plurality. Where a batch-type approach is implemented in the steps of training, this may involve training on a plurality of batches equivalent to the number of wells in a scenario where each relates to flow parameters, well parameters and/or an associated status of the at least one control point from only one of the plurality of production wells. It will be recognised that fewer iterative batch steps are required where one, or more, of the batches relate to data from two or more production wells in order to train on data from each of the wells.

Prior to the training of step (ii), or prior to each iterative training step, the method may comprising inputting the second model or a plurality of second models into the first model/combined model as discussed above. Subsequently, during training step (ii) or each iterative training step, the method may comprise obtaining an updated set of second parameters during step (ii), during some and/or during each iterative training step for the second model(s) relating to the production well(s), wherein the updated set of second parameters more accurately parameterise the properties specific to the production well(s) which the second model(s) relate; and updating the second model structure based on the updated set of second parameters. Where an iterative training is implemented, the second parameters may not be updated at each of the iterative training steps. They may for example only be updated at alternate iterative training steps. Additionally and/or alternatively, additional iterative training steps may be introduced into the iterative training regime where no update of the first parameters takes place, and there is only an update of the second parameters.

The generation of an updated set of second parameters shares many corresponding advantages as discussed above in relation to the training of the first/combined model and the generation of the updated first parameters. That is, the second parameters can be updated to better reflect the true physical configuration and characteristics that are specific to the wells to which they relate. As such, an updated second model(s) can be obtained that is/are better reflective of the production well(s) and thus allows for improved modelling of said well(s) without having shortcomings.

Where one, or more, second model(s) are introduced into the first/combined model prior to the optional step of training, or prior to each optional iterative training step, the data that is used for the training/training step may only be data that relates to the production well(s) to which the second model(s) relate. In that way, the second parameter(s) in the second model(s) are adjusted and updated specifically to the well to which they relate, and thus the second model(s) is/are provided with improved specificity for its/their respective well.

The method of the first aspect may comprise introducing at least one additional well into the first plurality of production wells; retraining the first/combined model on data relating to flow parameters, well parameters and/or an associated status of the at least one control point from the at least one additional well; obtaining a re-updated set of first parameters from the retraining of the first/combined model, wherein the re-updated set of first parameters more accurately parameterise the common properties of the first plurality of production wells; and updating the first/combined model based on the re-updated set of first parameters.

The at least one additional well may be a well that previously did not exist (i.e. a completely new well) and/or may be an already existing well for which the data has become newly available.

The at least one additional production well may be multiple production wells. As such, the first/combined model may be retrained on data relating to flow parameters, well parameters and/or an associated status of the at least one control point from one, some or all of these multiple wells.

The method may further comprise introducing a second model (optionally as part of the second model structure as discussed above) for the at least one additional well; and, prior to the step of retraining, incorporating the second model relating to the at least one additional well into the first/combined model such that the first/combined model is capable of describing a relationship between flow parameters, well parameters and/or an associated status of the at least one control point for only the at least one additional well. As such, the first/combined model, prior to the step of retraining, is tailored specifically to modelling the at least one additional well. Any updates to the first set of parameters (and optionally, as discussed further below, the second set of parameters) resulting from the step of retraining can hence be ensured to reflect and account for the behaviours and characteristics of the at least one additional well.

The method may comprise obtaining an updated set of second parameters for the second model relating to the at least one additional well from the step of retraining the first/combined model, wherein the updated set of second parameters more accurately parameterise the properties specific to the at least one additional well; and updating the second model relating to the at least one additional well based on the updated set of second parameters relating to the at least one additional well. It is in fact envisioned that during retraining it may not be necessary to update the first parameters at all after the addition of at least one well since the first parameters may have converged from previous training/retraining steps. As such, the retraining may involve only an update to the second parameters to account for the at least one additional well, and wherein the update to the first parameters may simply be considered as maintaining the first parameters at the value which they have converged.

Similar to the case for the training of the first/combined model, the retraining of the first/combined model may comprise a plurality of iterative retraining steps. Each step may be based on a different batch of data relating to flow parameters, well parameters and/or an associated status of the at least one control point from the at least one additional well.

Where an iterative retraining is implemented, the second parameters may not be updated at each of the iterative retraining steps. They may for example only be updated at alternate iterative training steps. Additionally and/or alternatively, iterative retraining steps may be introduced into the iterative retraining regime in which there is not an update of the first parameters, there is only an update of the second parameters.

In scenarios where the at least one additional well is multiple additional wells, a second model for each of the multiple additional wells may be generated/introduced (optionally into the second model structure). This ensures that there are second models that can account for the well specific behaviours of each of each of the multiple additional wells.

Each batch of data used in the retraining of the model may be randomly/stochastically selected from the total data available relating to flow parameters, well parameters and/or an associated status of the at least one control point from the additional well(s).

A corresponding step of retraining the first/combined model may equally be implemented not only when additional wells are newly introduced into the first plurality of production wells, but additionally and/or alternatively when new data becomes available for the existing wells within the first plurality of production wells. That is to say, the method of the first aspect may further comprise obtaining additional data relating to flow parameters, well parameters and/or an associated status of the at least one control point from at least one of the first plurality of production wells; retraining the first/combined model on the additional data; obtaining a re-updated set of first parameters from the retraining of the first/combined model, wherein the re-updated set of first parameters more accurately parameterise the common properties of the plurality of production wells; and updating the first/combined model based on the re-updated set of first parameters.

Prior to the step of retraining, the method may comprise inputting/incorporating the second model relating to the well for which additional data has been obtained into the first/combined model such that the resultant combined model is capable of describing a relationship between flow parameters, well parameters and/or an associated status of the at least one control point for only the at least one well from which the additional data has been obtained.

The method may further comprise obtaining, from the step of retraining, a re-updated set of second parameters for the second model relating to the at least one well from which the additional data has been obtained, wherein the re-updated set of second parameters more accurately parameterise the properties specific to the at least one of the production wells for which additional data has been obtained; and updating the second model relating to the well for which additional data has been obtained based on the re-updated set of second parameters. It is in fact envisioned that during retraining it may not be necessary to update the first parameters at all after additional data has been obtained since the first parameters may have converged from previous training/retraining steps. As such, the retraining may involve only an update to the second parameters to account for the at least one additional well, wherein the update to the first parameters can be considered as maintaining the first parameters at the value which they have converged.

As is the case for the training of the first/combined model, the retraining of the first/combined model may comprise a plurality of iterative retraining steps. Each step may be based on a different batch of data relating to flow parameters, well parameters and/or an associated status of the at least one well from which the additional data has been obtained.

Where an iterative retraining is implemented, the second parameters may not be updated at each of the iterative retraining steps. They may for example only be updated at alternate iterative training steps. Additionally and/or alternatively, iterative retraining steps may be introduced into the iterative retraining regime where there is not an update of the first parameters, there is only an update of the second parameters.

Additional data may be obtained for several, or all, of the first plurality of production wells.

Where additional data has been obtained from several (or all) of the plurality of wells, the method may comprise prior to the step of retraining (or each iterative step of retraining), inputting the second models relating to those wells for which additional data has been obtained into the first/combined model such that the first/combined model is capable of describing a relationship between flow parameters, well parameters and/or an associated status of the at least one control point for the wells for which additional data has been obtained.

If an iterative approach is taken toward the retraining of the first model in scenarios where additional data is obtained from several production wells, at least one batch of data, and optionally several or all batches of data, may relate to flow parameters, well parameters and/or an associated status of the at least one control point from at least two, and optionally more, of the several wells.

Each batch of data used in the retraining of the model may be randomly/stochastically selected from the total additional data available.

The optional steps of retraining the first/combined model as set out above provide the modelling with good adaptability, such that the new wells and/or new data can be accounted for in the existing first/combined model without the need for the generation of an entirely new model. The retraining will account for the necessary refinements of the first/combined model (by virtue of the re-updated first parameters) to incorporate the behaviour of the newly added wells/data. Thus, the retrained model can be used to model both the existing and new wells in the plurality in a relatively efficient and computationally inexpensive manner.

Using the retraining to obtain an updated/re-updated set of second parameters provides a corresponding adaptability to the second model(s) as is imparted to the first model by said retraining. By virtue of the retraining, the second model(s) can be made to account for the additional data from existing and/or new wells by a modification of the second parameters.

The optional steps of retraining the first/combined model, and the resultant further optional steps of the method of the first aspect, may be repeated every time an additional well/additional wells is/are added to the first plurality of wells and/or new data becomes available from any of the existing wells in the first plurality of production wells.

As an alternative to retraining the first/combined model, when new wells are added to the first plurality (i.e. when new data becomes available from a new set of wells not previously available) and/or when new data becomes available for existing wells within the first plurality, the first/combined model may be generated and trained afresh based on all of the available data relating to the first plurality of production wells. That is to say the method of the first aspect may simply be repeated when additional wells are added to the first plurality of wells and/or new data for existing wells in the first plurality of production wells becomes available. Equally, the second model(s) may be generated afresh when new wells are added to the first plurality of production wells (i.e. when new data becomes available from a new well/new set of wells not previously available) and/or when new data becomes available for existing wells within the first plurality.

The steps of training and retraining (and related concepts of the invention) as described above have been described in the context of (re)training the first model/combined model to (re)update the first set of parameters and/or incorporating the second model(s) to the first/combined model and (re)training in order to (re)update the second set(s) of parameters of the second model(s) in the first/combined model.

However, in addition, or as an alternative, to these training/re-training steps described above (and related concepts of the invention), corresponding training and/or retraining steps (and the related concepts of the invention) may be implemented in respect of/in order to (re)update one or more of: the further first sets(s) of parameter(s) of the further first model(s), the first set(s) of flow composition parameters of the flow composition model(s), the second set(s) of flow composition parameters of the well specific flow composition model(s), the prediction parameters of the prediction model(s), the well-specific prediction parameters of the well specific prediction models. As noted above, the (re)training to (re)update any one of these set(s) of parameters may happen instead of or in addition to the (re)training to (re)update the first and/or second set(s) of parameters.

The (re)update to any of the parameter set(s) resulting from the (re)training may occur in parallel to or separate from the update to any of the other parameter set(s).

Given the correspondence between the first model and the further first model(s), the prediction model(s) and the flow composition model(s) as described above, it will be appreciated that any (re)training carried out in respect of the parameters relating to any one of the further first model(s), the prediction model(s) and the flow composition model(s) may be carried out in a closely correspondent manner (i.e. mutatis mutandis) to that described above in respect of the first set of parameters of the first model.

Given the correspondence between the second model(s), the well-specific flow composition model(s) and the well-specific prediction model(s) as described above, it will be appreciated that any (re)training carried out in respect of the parameters relating to the well-specific flow composition model(s) and/or the well-specific prediction model(s) may be carried out in a closely correspondent manner (i.e. mutatis mutandis) to that described above in respect of the second set(s) of parameters of the second model(s).

Thus, as described above, optional steps of training, obtaining an updated set of parameters and updating the combined model may be implemented in respect of the, several or each further first model, the, several or each, flow composition model, the, several or each well specific flow composition model, the, several or each prediction model and/or the, several or each well specific prediction model. These steps may be carried out in a mutatis mutandis manner to the corresponding steps applied to the first model/second model as described above, and may happen in combination (e.g. in parallel) with or as an alternative to one another. The training of any of these models may be carried out prior to its/their combination as part of the combined model, or may be carried after combination into the combined model.

Any updated set of parameters obtained from the training may more accurately parameterise the properties relevant to the production well(s) to which the respective model(s) relate(s).

The generation of an updated set of parameters for any of the models shares many corresponding advantages as discussed above in relation to the training of the first/combined model and the generation of the updated first parameters. That is, the parameters can be updated to better reflect the true physical configuration and characteristics of the well/wells. As such, updated models can be obtained that are better reflective of each of the production wells to which they relate and thus allows for an improved accuracy of modelling.

The data used as the basis of the generation or training of the models may be measured directly in relation to the status of the at least one control point, the flow parameters and/or well parameters. This type of 'raw' data is often gathered into a real-time database by an operator for a flow network/production well, and is stored as a record of operation.

The data used as the basis of the generation and/or training of any of the models may additionally and/or alternatively be data resulting from a mining and/or compaction of original, raw data. Compacted data may be derived from the large volumes of raw data that are recorded in relation with oil and gas production wells, which is then categorised and compacted based on the categorisation of datasets within the time intervals and by the use of statistics. The resulting statistical data can represent certain aspects of the original data in a far more compressed form, and it can also be more readily searched in order to identify events or patterns of events. This statistical data may be stored in a compact database, which the input to the training/retraining of the first aspect can be based on. The statistical data can provide information concerning the operation and behaviours of the plurality of production wells without the need for all the raw, original data. Methods of data compaction for production well data is described in the Applicant's patent publications WO 2017/077095 and WO 2018/202796 A1. The methods disclosed in these publications may be used to provide a compacted data set that forms the basis of the training and/or retraining steps of the present invention.

For instance, the method of the first aspect may comprise: (1) gathering data covering a period of time relating to flow parameters, well parameters and/or an associated status of the at least one control point; (2) identifying multiple time intervals in the data during which the at least one control point, the flow parameters and/or the well parameters can be designated as being in a category selected from multiple categories relating to different types of stable production and multiple categories relating to different types of transient events, wherein the data hence includes multiple datasets each framed by one of the multiple time intervals; (3) assigning a selected category of the multiple categories to each one of the multiple datasets that are framed by the multiple time intervals; and (4) extracting statistical data representative of some or all of the datasets identified in step (2) to thereby represent the original data from step (1) in a compact form including details of the category assigned to each time interval in step (3).

Steps (1) to (4) may be carried out prior to the generation of any of the model(s) and/or the step of training. As such, the generation of any model and/or its training steps may be based on the data in compact form.

In some circumstances the compaction of the data at step (4) is not needed and in fact the steady state intervals may be directly used for training and/or model generation.

The data used in the invention may include data points that relate to only a single well. That is, the data may only be representative of flow parameters, well parameters and/or an associated status of the at least one control point from only one of the plurality of production wells. Such data may, for instance, be collected at a test separator where only the output of one of the plurality of production wells is being fed to said test separator. Alternatively, such data may, for example, be from, or derived from, a flow meter positioned within only a flow path associated with one production well.

Additionally and/or alternatively, the data used in any of the steps of the method may include data points which relate to, or are derived from data points which relate to, multiple wells. As an example, the data may include, or be derived from, topside data/measurements, wherein the topside data/measurements relates to several wells. Such data points may include data/measurements collected at flow meters within a flow path containing co-mingled flow from multiple production wells. Such data points may alternatively be from a separator to which flow from several of the plurality of production wells is directed. As a further example, mass balance equations for comingled flow (based on data relating to several of the plurality of production wells) can be utilized to create virtual measurements for individual production wells that are not measured. Thus, each data point used can relate to, or be derived from data points that relate to, more than one production well. The Applicant's earlier patent publication, WO 2019/110851, further details the use of topside data as the basis of model training and the use of such data described therein may also be used in the context of the present invention. However, in the context of the present invention, this data may be used in a transfer learning context rather than for the training of well specific models as disclosed in WO 2019/110851.

Generation of any one of the models as referred to herein may be considered as designing the architecture of a mathematical model and/or a statistical model and/or a data driven model, and/or a machine learning model and/or a neural network model and/or decision trees and/or support vector machines and/or regression models and/or Bayesian networks and/or genetic algorithms, wherein the designing includes, but is not limited to, specifying the number of parameters/variables; specifying the mathematical relationship between random variables and other non-random variables; specifying the relationships and variables/parameters where the relationships may be described as operators, such as algebraic operators, functions, differential operators, and where the variables are abstractions of system parameters of interest that can be quantified; and/or specifying the activation functions, connections and weights and/or logical rules. This is such that the any of the model parameters/variables may be quantified and, optionally, trained, from the data from one or more production wells; and/or such that any one of the models may be used by inputting data from one or more wells to estimate, predict and/or optimise as set out above.

Combining any of the models as referred to above may comprise: specifying the relationship/operators of a/the model(s) to ensure that an output (e.g. in the form of data) from a/the model(s) becomes an appropriate input (e.g. in the form of data) to another/other model(s). The output from a/the model(s) may be summarized, multiplied and/or (weighted) averaged with an output from another/other model(s) prior to input into another/other model(s).

The aspects of the invention described above will have to be implemented on a computer system of sorts. That is to say, the above described methods are necessarily computer implemented methods.

Thus, in a further aspect of the invention, there is provided a computer system for modelling one of a plurality of production wells, for estimating a flow parameter, a well parameter and/or the status of at least one control point for at least one hydrocarbon production well, and/or for predicting a flow parameter, a well parameter and/or the status of at least one control point for at least one hydrocarbon production well, wherein the computer system is configured to perform the method of any of the aspects as set out above.

In a further aspect, there is also provided a computer program product comprising instructions for execution on a computer system arranged to receive data relating to flow parameters, well parameters and/or an associated status of the at least one control point from the plurality of production wells; wherein the instructions, when executed, will configure the computer system to carry out a method of any of the aspects set out above.

Certain embodiments of the present invention will now be described, by way of example, and with reference to the accompanying drawings, in which.

Figure 1:
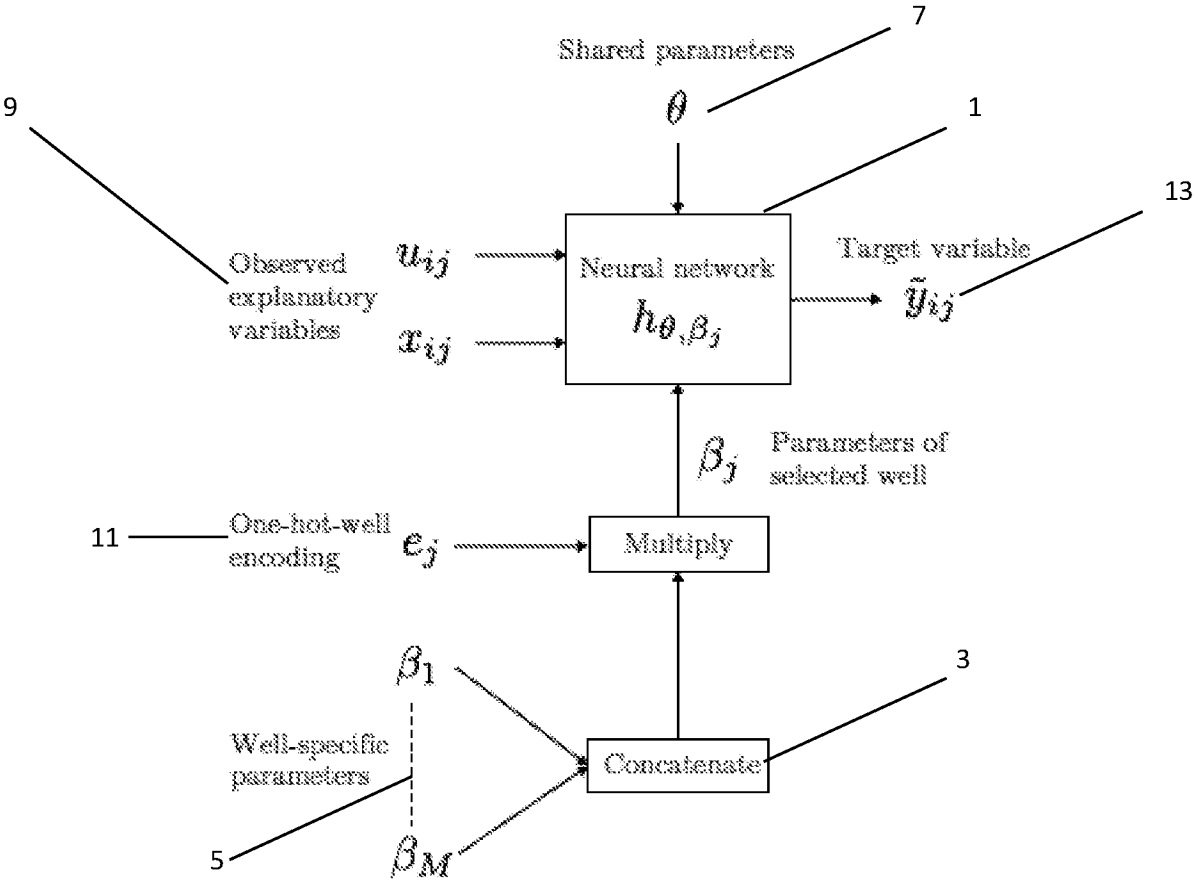
FIG. 1 is a schematic of a generic architecture for modelling flow rate for one of a plurality of production wells in accordance with an embodiment of the invention.

FIG. 1 shows a transfer learning architecture having a first model 1 comprised of a neural network and a second model structure 3 comprising of a plurality of second models 5. In this embodiment, each second model 5 consists of a set of second parameters β in vector form. As such, the second model structure 3 can be considered as a second model matrix The first model 1 is capable of modelling the fluid flow rate from any one of a plurality of hydrocarbon production wells, and comprises therein a set 7 of first parameters θ. The first model 1 is generated initially from a desired specification, which includes the variables that are to be input to the model, the desired output variables (in the present case, fluid flow rate), the model architecture, and the model/number of model parameters. Once the first model 1 has been generated in accordance with the desired specification, the set 7 of first parameters θ are stochastically generated and input to the first model 1 to initialise the first model 1. The set 7 of first parameters θ within the first model are representative of the physical properties and characteristics common to all of the plurality production wells and allow for the model to account for such behaviours when modelling a particular production well.

Each second model 5 represents one of the plurality of production wells and is capable of describing a relationship between flow parameters, well parameters and/or an associated status of the at least one control point for that production well. As noted above, in this embodiment, each second model 5 consists of a set of second parameters β. The set of second parameters β are specific to the related production well within the plurality and are representative of properties that are specific to that production well. After initial generation of each of the second models 5, the second parameters β are stochastically generated to initialise each of the second models 5.

The second model structure 3 is generated from the plurality of second models 5. This comprises a concatenation of each of the plurality of second models 5.

After initial generation of the first model 1 and the second model structure 3, the step of training the first model 1 is commenced. The aim of the training is to update the first parameters θ and the second parameters β within the first model 1 and second model structure 3 respectively such that the first parameters θ more accurately parameterise those properties common to all of the plurality of production wells and the second parameters β more accurately parameterise the properties specific to each of the plurality of the production wells. As a result, the first model 1 will more accurately describe for any one of the plurality of production wells a relationship between flow parameters, well parameters and/or an associated status of the at least one control point as compared to the originally initialised first model 1 comprising stochastically generated first parameters θ. Similarly, as a result of the training, each second model 5 will more accurately describe a relationship between flow parameters, well parameters and/or an associated status of the at least one control point for its production well as compared to each of the respective initialised second models comprising the stochastically assigned parameters.

The training is achieved by inputting data 9 relating to flow parameters, well parameters and/or an associated status of at least one control point associated with each of the plurality of production wells into the first model 1. In this embodiment, the data 9 input, and which underpins the training procedure, is data 9 from each (i.e. all) of the plurality of production wells.

In this embodiment, the training of the first model 1 initially comprises determining a number of training steps that are to form the basis of the training procedure before termination (though in other embodiments an adaptive training regime may be implemented, e.g. wherein a termination condition determines the number of training steps rather than a pre-determined number of steps). Once the number of training steps is determined, training commences by stochastically selecting a batch of data from the total data 9 available relating to the plurality of production wells. The batch of data may contain data from a single well within the plurality, from multiple wells, or may contain topside data representative of multiple wells. The exact nature of each batch of data will be determined prior to training of the first model 1 is commenced and will be dependent on the specific iterative training regime to be implemented.

After selection of a batch of data, a signal 11 is created for the batch of data. The signal 11 is specific to only those of the plurality of production wells which the batch of data is from. The effect of the signal 11 is such that upon input of the signal 11 into the second model structure 3 only those second models 5 relating to those wells from which the batch of data has been collected (i.e. only those second parameters β that relate to the wells from which the batch of data has been collected) remain within the second model structure 3. As such, after input of the well specific signal 11, the second model structure 3 is specifically tailored for modelling only those of the plurality of production wells to which the signal 11 relates.

In the present embodiment, the signal 11 input into the second model structure 3 is in the form of a binary vector. As such, the operation of inputting the signal 11 into the second model structure 3 involves a simple vector-matrix multiplication, wherein the result is a contracted, tailored second model structure 3 containing only those second models 5 relating to the second models from which the data in the training batch has been derived.

Once the tailored second model structure 3 is produced such that only those second parameters β relating to the production wells which the batch of training data is from, the second model structure 3 is input into the first model 1. In this particular embodiment, this is achieved by producing a plurality of copies of the first model 1 equal to the number of second models 5 in the second model structure 3. Subsequently, each second model 5 from the tailored second model structure is fed into its own respective copy of the first model 1 to form a combined model. The resultant combined models will thus be tailored to modelling the specific well to which the input second model 5 relates.

At this stage, the data 9 from the selected batch is run through the (copies of) the combined model. Only the data 9 relating specifically to the production well which the (or each copy of the) tailored combined model relates is fed into the (or each copy of the) combined model.

The data 9 input to each of the combined models, which may also be considered as tailored first models 1, results in an output of an estimated flow rate for the specific production well which the tailored first model relates. This estimated flow rate is then compared to a flow rate 13 actually measured for that production well at a time when the input data had been collected. This comparison allows for the computation of a batch loss, which can be considered as an error of each tailored first model 1 on the data in the batch (i.e. a discrepancy between the estimated and measured flow rate 13). From this batch loss, gradients of the batch loss with respect to the first θ and second β model parameters can be calculated. These gradients are then used to update the first θ and second β model parameters in order to create a first model 1 and second model structure 3 having a decreased batch loss. This update of the first θ and second β model parameters to decrease batch loss occurs in parallel across each copy of the first model 1 required for training in that step on that batch of data. This training step is then terminated, and the first model 1 and the second model structure 3 are updated based on the resultant updated first θ and second β model parameters.

Subsequent to the termination of this iterative training step, a new batch from the data 9 is stochastically selected and the resultant training stages as set out above are repeated to obtain further updated first θ and second β model parameters. This is iterated for data from each of the plurality of production wells until the predetermined number of training steps has been completed.

Further specifics of the training of the model are set out in equation (4) below:

$$(\theta^*,\beta^*_1,\ldots,\beta^*_M)=\operatorname{argmin}_{(\theta,\beta_1,\ldots,\beta_M)}=\Sigma_{j=1}^{M}\Sigma_{i=1}^{N_j}(y_{ij}-h_{\theta,\beta_j}(u_{ij},x_{ij}))^2 \quad (4)$$

In equation (4) $u_{ij}$, $x_{ij}$ represents the batch of data input in each iterative step of the method. Here each batch is of size one (i.e. consists of a single data point i for well j), and includes both control variables $u_{ij}$ and measurements of the state $x_{ij}$. $h_{\theta,\beta_j}$ represents the tailored first model 1 (i.e. the combined model), which has the second model structure 3 relating to the production wells from which the batch of data has been derived incorporated therein. $(\theta^*,\beta^*_1,\ldots,\beta^*_M)$ represents the updated first parameters θ and second parameters β achieved from the training of the well. M represents the number of production wells within the plurality, j represents the index of each well and $N_j$ represent the data points for each well. The model is trained by solving equation (4) using a stochastic gradient descent method (SGD) as outlined in broad terms above.

After completion of the training, an updated first model 1 and second model structure 3 are arrived at, with updated first θ and second β model parameters resulting from the iterative training regime. These updated parameters provide both the first model 1 and the second model structure 5 with an improved accuracy in modelling the well-generic behaviours and well-specific behaviours, respectively.

The resultant trained first model 1 and second model structure 5 can then be used to estimate the flow rate for any of the plurality of the production wells. As such, estimations based on a state comprising flow parameters, well parameters and/or an associated status of the at least one control point of the one of the plurality of production wells may be made for any of the plurality of production wells. This would involve the input of such a state into the trained model 1 with the additional input of those second parameters β (i.e. that second model 5) relating to the production well for which the estimation is being made. The relevant second parameters β can again be selected out from the second model structure 3 via input of an appropriate well specific signal into the second model structure 3. Equation (5) sets out an estimation made using the trained first model 1 and second model structure 3.

$$\widetilde{y_{ij}}=h_{\theta^*,\beta^*_j}(u_{ij},x_{ij}) \quad (5)$$

Here, $u_{ij}$, $x_{ij}$ pertains to the state of the production well for which the estimation is being carried out for, $h_{\theta^*,\beta^*_j}$ represents the trained first model 1 (incorporating the updated first parameters θ*) having the relevant trained second model structure 3 (incorporation the updated second parameters $\beta^*_j$) input therein so as to form a combined model, and $\widetilde{y_{ij}}$ represents the estimated flow rate of the production well.

The fact that the training in this embodiment is based on data 9 from each of the wells within the plurality of production wells ensures that, in particular, the first model 1 has improved accountability of, for instance, the reservoir effect. It also helps to ensure that the first model 1 is not solely influenced on the limited data from a single well. As such any estimations made through use of the trained first model 1 and second model structure 5 can, by virtue of the training, be ensured to have improved accuracy with a reduced likelihood of error resulting from a poor accountability of, for instance, the reservoir effect and/or a limited training data set.

Furthermore, not only can the estimations made account for those properties and behaviours that are common across the plurality of production wells without being heavily misguided by ill account of the reservoir effect and/or a limited training data set by virtue of the first model 1, by virtue of the refined second parameters β within the second model structure 3 the estimations made using the combination of the trained first model 1 and second model structure 3 can accurately account for those properties and behaviours specific to each of the plurality of production wells.

Figure 2:
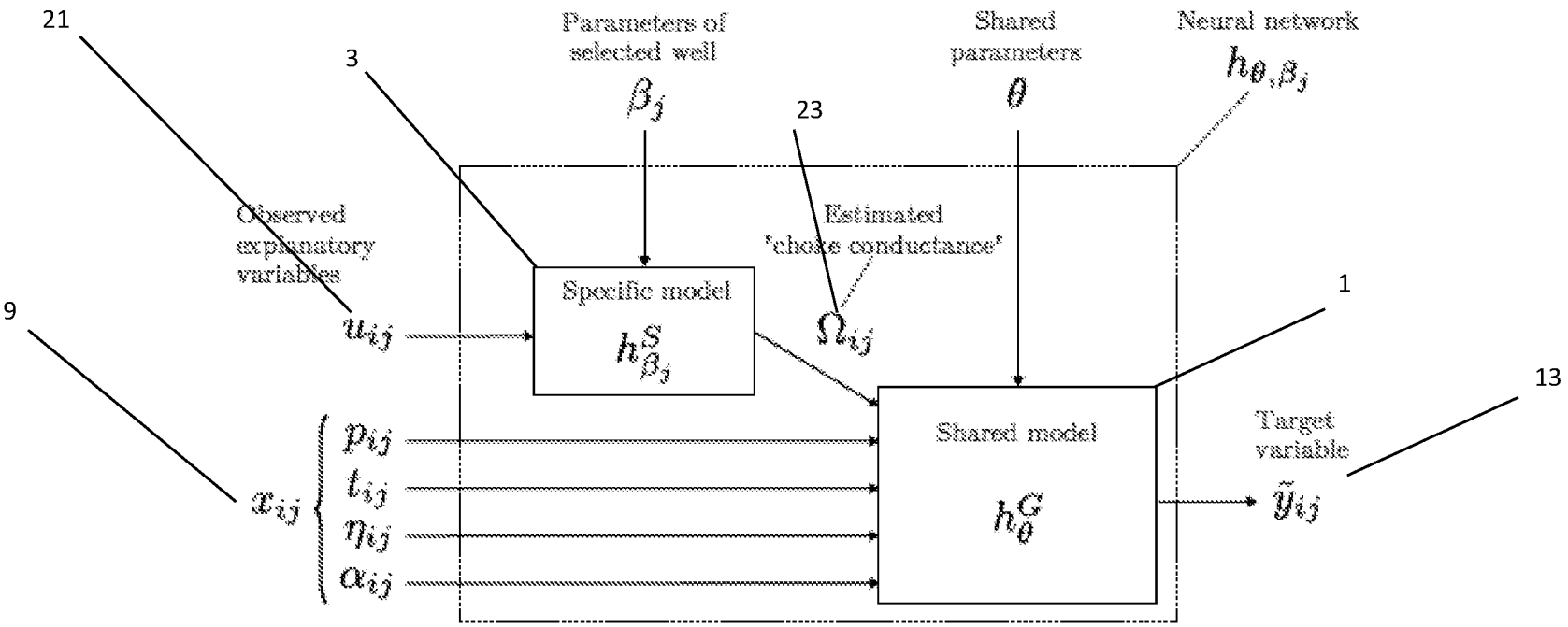
FIG. 2 is a schematic of an architecture for modelling choke flow in accordance with an embodiment of the invention.

FIG. 2 is a schematic of a transfer learning architecture specifically designed for modelling choke flow through choke valves within the flow paths associated with each of the plurality of production wells. The FIG. 2 architecture can be seen to be a more specific example of the architecture underlying the FIG. 1 embodiment, and thus shares many of the same corresponding features. For instance, the FIG. 2 architecture comprises a first model 1 in the form of a neural network and a second model structure 3 comprising of a plurality of second models 5.

As in the above embodiment, the second model structure 3 initially incorporates a second model 5 for each of the plurality of production wells. Each second model 5 comprises a set of second parameters β representative of behaviours and properties specific to each of the plurality of production wells. Then, upon input of a well specific signal 11 relating to those production wells from which the training data has been obtained, a tailored second model structure 3 comprising only those second models 5 relating to those production wells from which the training data has been obtained is produced. This is the second model structure 3 shown in FIG. 2, with the step of inputting the well specific signal 11 to contract the second model structure 3 down into its tailored form as described above not being shown in this Figure.

As is also the case for the FIG. 1 embodiment, the first model 1 of the FIG. 2 embodiment comprises a set of first parameters θ representative of behaviours and properties common to each of the plurality of production wells.

In this embodiment, the second model structure 3 maps choke position to "choke conductivity" (which can be thought of as the resistance to flow through each of the choke valves). In view of this, the second model structure 3 of the FIG. 2 embodiment differs from that of the FIG. 1 embodiment in that the second models 5 comprise more than just the second model parameters β; they additionally comprise an element allowing for the input of a position 21 of a choke valve such that resistance to flow as compared to the position 21 of the choke valve can be mapped by each of the second models 5. As such, the second model structure 3 of the FIG. 2 embodiment allows for a simpler interpretation of each of the second models 5, the second parameters β and its output.

The type and sizing of the choke valve may differ from well to well, and it is therefore desired to have a well-specific model 5 that maps choke position 21 to choke conductivity for each of the plurality of production well.

The training and subsequent estimation carried out using the model architecture of FIG. 2 largely corresponds to the training and the estimation described above in relation to the FIG. 1 embodiment, and as such it will not be described again here in detail. Where the training/estimation of the FIG. 2 embodiment differs however is that, in addition to the well specific signal 11, the choke position 21 is input into the second model structure 3 prior to each iterative training step and/or estimation. From said input, a mapping of the choke position to the choke conductivity 23 is output from the second model structure 3, and it is this second model output 23 that is input into the first model 1, along with data 9, prior to each iterative training step and/or an estimation of a well characteristic 13 using the second model architecture.

The model architecture of the FIG. 2 embodiment can account for both the behaviours and properties that are common to each of the plurality of production wells by virtue of the first model 1, and can additionally account for the choke conductivity, which is a behaviour/property that is specific to each of the plurality of production well, by virtue of the second model structure 3.

Figure 3:
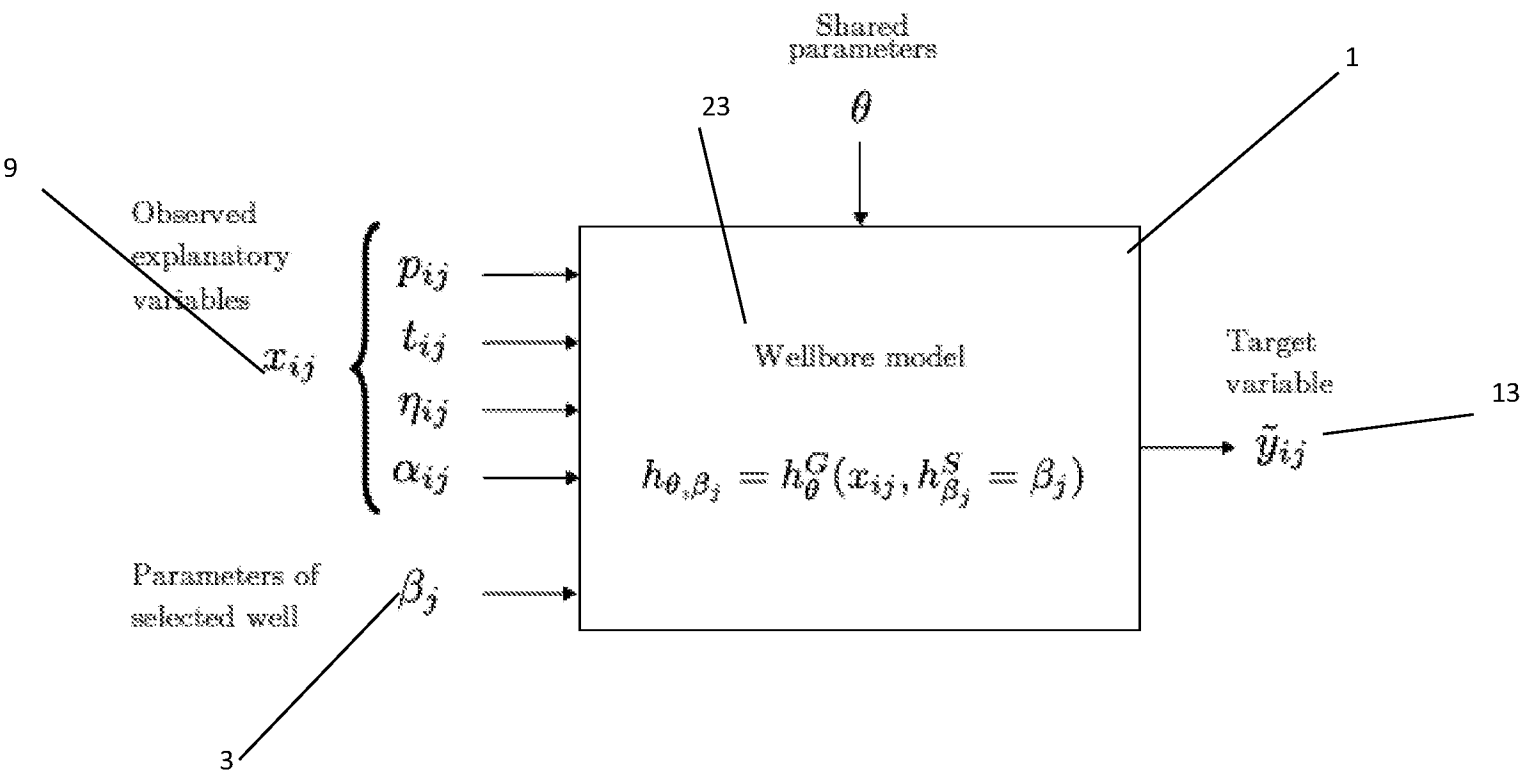
FIG. 3 is a schematic of an architecture for wellbore modelling in accordance with an embodiment of the invention.

FIG. 3 is a schematic of a further transfer learning architecture. The FIG. 3 transfer learning architecture is specifically designed for wellbore modelling. The FIG. 3 architecture can be seen to be a more specific example of the architecture underlying the FIG. 1 embodiment, and thus shares many of the same corresponding features. For instance, the FIG. 2 architecture comprises a first model 1 in the form of a neural network and a second model structure 3 comprising of a plurality of second models 5.

As in the above embodiment, the second model structure 3 initially incorporates a second model 5 for each of the plurality of production wells. Each second model 5 comprises a set of second parameters β representative of behaviours and properties specific to each of the plurality of production wells. Then, upon input of a well specific signal 11 relating to those production wells from which the training data has been obtained, a tailored second model structure 3 comprising only those second models 5 relating to those production wells from which the training data has been obtained is produced. This is the second model structure 3 shown in FIG. 3, with the step of inputting the well specific signal 11 to contract the second model structure 3 down into its tailored form is thus not being shown in this Figure.

As is also the case for the FIG. 1 embodiment, the first model 1 comprises a set of first parameters θ representative of behaviours and properties common to each of the plurality of production wells.

In the embodiment of FIG. 3, the second model structure 3 merely consists of the second model parameters β, which help to capture the unique relationship for each well bore between the total flow rate and the data 9 relating to flow parameters, well parameters and/or an associated status of the at least one control point from the production well associated with that wellbore. That is, the second model parameters β capture those properties unique to each well bore, and which cannot be generalised across all wells within the first parameters θ.

The training and subsequent estimation carried out using the model architecture of FIG. 3 largely corresponds to the training and the estimation described above in relation to the FIG. 1 embodiment, and as such it will not be described again here in detail.

The model architecture of the FIG. 3 embodiment can account for both the behaviours and properties that are common to each of the plurality of production wells by virtue of the first model 1, and can additionally account for those that are a unique result of the well bore to which each production well is connected by virtue of the second model structure 3.

Figure 4:
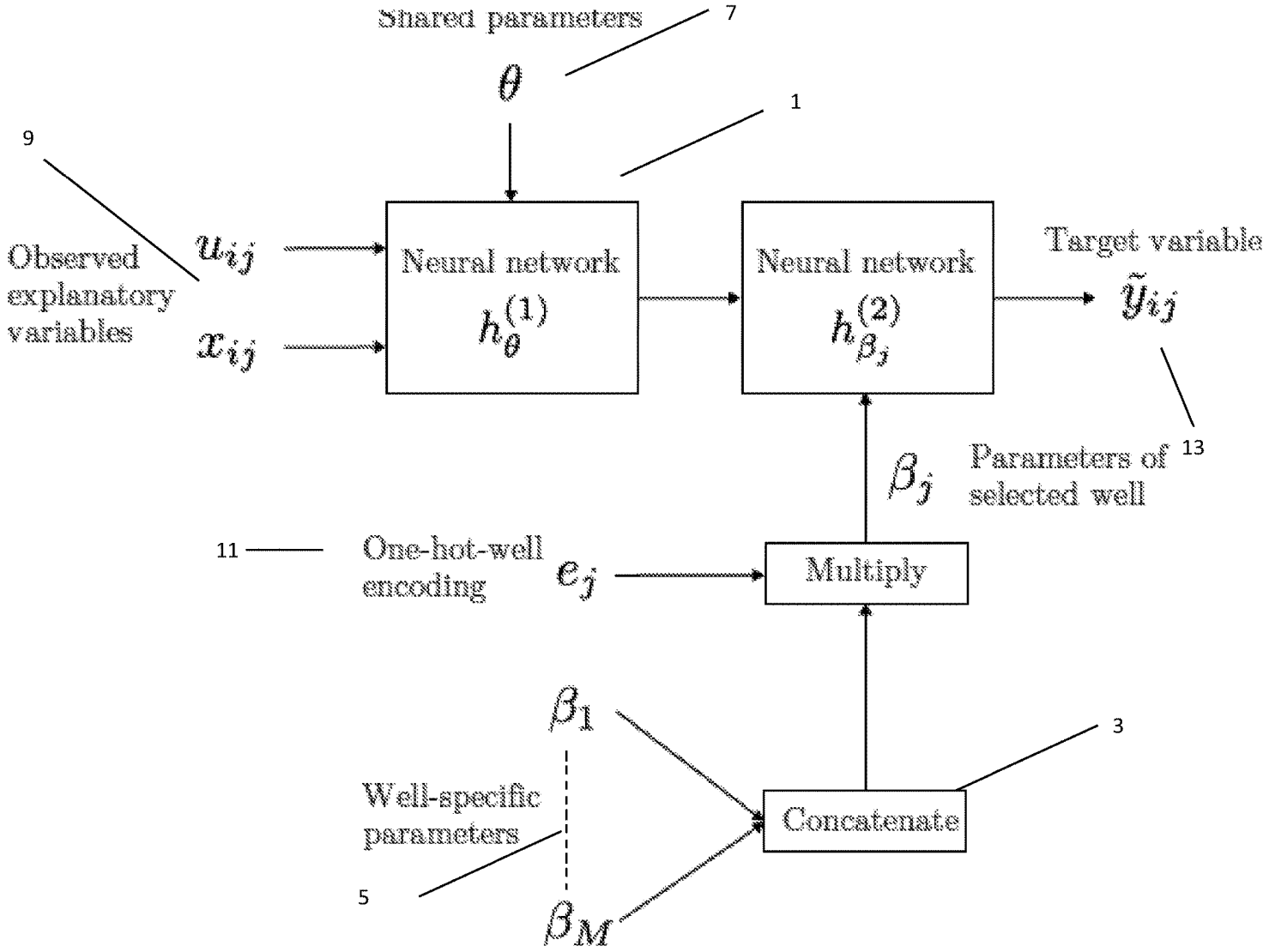
FIG. 4 is a schematic of an alternative generic architecture for modelling in accordance with an embodiment of the invention.

FIG. 4 shows an alternative generic architecture for modelling in accordance with alternative embodiments. The architecture of FIG. 4 shares many similarities with that represented in FIG. 1. In particular, the architecture of FIG. 4 comprises a first model 1 comprised of a neural network and a second model structure 3 comprising of a plurality of second models 5. As for FIG. 1, each second model 5 consists of a set of second parameters β in vector form. As such, the second model structure 3 can be considered as a second model matrix. The first model 1 and second model structure 3 of FIG. 4 are directly comparable to the corresponding models discussed above in connection with FIG. 1, and can be trained and used as the basis for estimation in a manner correspondent to that which was described above in connection the architecture of FIG. 1.

Where the architecture of FIG. 4 differs to that described above in connection with FIG. 1 however, is that rather than incorporating each second model 5 into a respective copy of the first model 1 prior to input of the data 9 (whether that be during training or estimation as described above in connection with FIG. 1), the relevant data 9 is input into the first model 1 prior to input of the second model 5 into the respective first model 1. This is an alternative approach to the modelling architecture to that discussed above, and is a common approach for neural network based modelling. That is, in the resultant neural network forming the combined model (i.e. the tailored first model 1) in the context of the FIG. 4 embodiment, the shared (hard) parameters form part of the first layers of the architecture, and the specific parameters form part of the last layer (or layers) of the neural network.

The above described embodiments set out in detail the aspects of the invention relating to the first model, the second model and their combination with one another. It also sets out in detail how the first and second models might be trained, and how an estimation might be achieved using the combined model resulting from the first and second model. This description therefore gives an appreciation of specific embodiments of the invention, and it will be apparent to the skilled how these aspects of the invention that have been described in detail can map on to those that do not form part of the specific embodiments herein.

For instance, from the discussion above in connection with the first model, and how it is generated, trained and used as the basis of estimation, the skilled person will gain an understanding of how the, or each, further first model, the, or each, prediction model, and the, or each, flow composition model may be generated, trained and used as the basis of estimation and/or prediction given the correspondence between the structure and architecture of these models.

Similarly, from the discussion above in connection with the second model, and how it is generated, trained and used as the basis of estimation, the skilled person will gain an understanding of how the, or the, or each, well specific prediction model, and the, or each, well specific flow composition model may be generated, trained and used as the basis of estimation and/or prediction given the correspondence between the structure and architecture of these models.

The combination of the first and second models as described above also provides an understanding of how any of the models of the invention may be combined with one another as part of a combined model for modelling and later use in estimation, prediction and optimisation.

The invention claimed is:

1. A method of operating a computer system for modelling one hydrocarbon production well of a first plurality of hydrocarbon production wells, the method comprising:

receiving, for each hydrocarbon production well of the first plurality of hydrocarbon production wells, respective data relating to flow parameters of the respective hydrocarbon production well, and/or well parameters of the respective hydrocarbon production well, and/or an associated status of at least one control point in a flow path associated with the respective hydrocarbon production well, wherein the wells of the first plurality of wells are not all connected to a same hydrocarbon reservoir; and generating, using data-driven modelling, a first data-driven well model that models, for any individual hydrocarbon production well of the first plurality of hydrocarbon production wells: flow parameters of the hydrocarbon production well, and/or well parameters of the hydrocarbon production well, and/or an associated status of at least one control point in a flow path associated with the hydrocarbon production well, wherein the first data-driven well model is parameterised by a set of first model parameters representative of properties common to all of the first plurality of hydrocarbon production wells, and wherein generating the first data-driven well model comprises processing the received data in the computer system using data-driven modelling to determine, for each of the first model parameters, a respective value of the first model parameter in dependence upon data received for all of the first plurality of hydrocarbon production wells.

2. The method of claim 1, further comprising:

receiving, for each hydrocarbon production well of a further, different plurality of hydrocarbon production wells, respective data relating to flow parameters of the respective hydrocarbon production well, and/or well parameters of the respective hydrocarbon production well, and/or an associated status of at least one control point in a flow path associated with the respective hydrocarbon production well;

generating, using data-driven modelling, further first data-driven well model that models, for any individual hydrocarbon production well of the further plurality of production wells: flow parameters of the hydrocarbon production well, and/or well parameters of the hydrocarbon production well, and/or an associated status of at least one control point in a flow path associated with the hydrocarbon production well, wherein the further first well model is parameterised by a further set of first well model parameters representative of properties common to all of the further plurality of production wells, and wherein generating the further first data-driven well model comprises processing the received data in the computer system using data-driven modelling to generate the further set of first well model parameters in dependence upon the data received for all of the further plurality of production wells; and combining the first well model with the further first well model to form a combined well model that models, for any individual hydrocarbon production well in the first plurality or the further plurality of production wells: flow parameters of the hydrocarbon production well, and/or well parameters of the hydrocarbon production well, and/or an associated status of at least one control point in a flow path associated with the hydrocarbon production well.

3. The method of claim 2, further comprising:

receiving, for each hydrocarbon production well of a plurality of further, different pluralities of hydrocarbon production wells, data relating to flow parameters of the respective hydrocarbon production well, and/or well parameters of the respective hydrocarbon production well, and/or an associated status of at least one control point in a flow path associated with the respective hydrocarbon production well;

generating, using data-driven modelling, a plurality of further first data-driven well models, each further first well model modelling, for a respective individual hydrocarbon production well of the respective further plurality of production wells: flow parameters of the hydrocarbon production well, and/or well parameters of the hydrocarbon production well, and/or an associated status of at least one control point in a flow path associated with the hydrocarbon production well, wherein each further first well model is parameterised by a respective set of first well model parameters representative of properties common to the respective further plurality of production wells, and wherein generating each further first data-driven well model comprises processing the received data in the computer system using data-driven modelling to generate the respective further set of first well model parameters in dependence upon the data received for all of the further plurality of production wells; and combining the first well model with the plurality of further first well models to form a combined well model that models, for any individual hydrocarbon production well of the first plurality or any further plurality of production wells: flow parameters of the hydrocarbon production well, and/or well parameters of the hydrocarbon production well, and/or an associated status of at least one control point in a flow path associated with the hydrocarbon production well.

4. The method of claim 2, wherein at least some of the production wells within the, or each, further plurality of production wells are not included in the first plurality of production wells.

5. The method of claim 2, wherein at least some of the production wells within the, or each, further plurality of productions wells are also in the first plurality of production wells.

6. The method of claim 5, wherein all of the production wells within the, or each, further plurality of production wells are in the first plurality of production wells, and wherein the first plurality of production wells additionally includes further production wells.

7. The method of claim 1, comprising generating a well flow-composition model that models, for any individual hydrocarbon production well of a second plurality of hydrocarbon production wells, the flow composition of the fluid produced by the hydrocarbon production well and: flow parameters, and/or well parameters, and/or an associated status of at least one control point, and/or time, wherein the well flow-composition model is parameterised by a first set of flow composition parameters that are representative of the flow composition common to all of the second plurality of production wells; and combining the well flow-composition model with the first model to form a combined model that models, for any individual hydrocarbon production well within the second plurality and the first plurality of production wells: flow parameters, and/or wells parameters, and/or an associated status of the at least one control point, and/or time.

8. The method of claim 1, comprising:

generating a well-specific flow-composition model that models the flow composition of the fluid produced from only one production well and: flow parameters, and/or well parameters, and/or an associated status of the at least one control point, and/or time, wherein the well-specific flow-composition model is parameterised by a second set of flow composition parameters that are representative of the flow composition specific to the production well to which well-specific flow-composition model relates; and combining the well-specific flow-composition model with the first model to form a combined model that models: flow parameters, and/or well parameters, and/or an associated status of the at least one control point, and/or time for only the one production well.

9. The method of claim 8, comprising:

generating a plurality of well-specific flow-composition models, each well-specific flow-composition model modelling the flow composition of the fluid produced from only one, respective well and: flow parameters, and/or well parameters, and/or an associated status of the at least one control point, and/or time, each well specific model being parameterised by a second set of flow composition parameters that are representative of the flow composition that is specific to the only one, respective production well to which the well specific model relates; and combining each well-specific flow-composition model with the first model to form combined models that each model: flow parameters, and/or wells parameters, and/or an associated status of the at least one control point, and/or time, for each respective well.

10. The method of claim 1, comprising:

generating a well prediction model, the well prediction model capable of predicting for any individual production well of a third plurality of production wells, a change in: a flow parameter, well parameter, and/or a status of the at least one control point, based on: a hypothetical change in the status of the at least one control point, a hypothetical change in a well parameter, and/or a hypothetical change in a flow parameter, wherein the well prediction model is parameterised by a set of prediction parameters that are representative of properties that are common to the third plurality of production wells; and combining the well prediction model with the first well model to form a combined well model that is capable of predicting, for any individual production well within the third plurality of production wells and the first plurality of production wells: a flow parameter, and/or a well parameter, and/or the status of the at least one control point, resulting from: a hypothetical change in the status of the at least one control point, and/or the hypothetical change in a well parameter, and/or the hypothetical change in a flow parameter.

11. A method of predicting a flow parameter, and/or well parameter, and/or status of at least one control point, for at least one production well, comprising:

operating a computer system in accordance with claim 10; and inputting a hypothetical change in the status of the at least one control point, and/or a hypothetical change in a well parameter, and/or a hypothetical change in a flow parameter, associated with the at least one production well, into the combined well model and thereby obtaining a predicted flow parameter, and/or well parameter, and/or status of the at least one control point, for the at least one production well.

12. A method of optimising hydrocarbon production from at least one hydrocarbon production well, comprising:

predicting a flow parameter, a well parameter, and/or the status of the at least one control point, for at least one hydrocarbon production well in accordance with claim 11;

repeating the prediction of claim 11 based on a different hypothetical change to the status of the at least one control point, and/or a different hypothetical change to the well parameter, and/or a different hypothetical change to the flow parameter; and determining an optimised status of the at least one control point, and/or the flow parameter, and/or the well parameter and thereby optimised hydrocarbon production; and wherein optionally the prediction of claim 11 is repeated a plurality of times based on a plurality of different hypothetical changes to the status of the at least one control point, and/or different hypothetical changes to the flow parameter, and/or different hypothetical changes to the well parameter.

13. The method of claim 1, comprising:

generating a well-specific prediction model, the well-specific-prediction model capable of predicting, for only one production well, a change in: a flow parameter, a well parameter, and/or the status of the at least one control point based on: a hypothetical change in the status of the least one control point, and/or a hypothetical change in a well parameter, and/or a hypothetical change in a flow parameter, wherein the well-specific prediction model is parameterised by a set of well-specific prediction parameters that are representative of properties specific to that production well; and combining the well-specific prediction model with the first well model to form a combined well model that is capable of predicting: a flow parameter, and/or a well parameter, and/or the status of the at least one control point, resulting from: a hypothetical change in the status of the at least one control point, and/or the hypothetical change in a well parameter, and/or the hypothetical change in a flow parameter, for only the one production well.

14. The method of claim 13, comprising:

generating a plurality of well-specific prediction models, each well-specific prediction model capable of predicting, for only one, respective production well, a change in: a flow parameter, a well parameter, and/or the status of the least one control point based on: a hypothetical change in the status of the at least one control point, and/or a hypothetical change in a well parameter, and/or a hypothetical change in a flow parameter, wherein each well-specific prediction model is parameterised by a set of well-specific prediction parameters that are representative of properties that are specific to the production well to which the well-specific prediction model relates; and combining each well-specific production model with the first well model to form combined well models that are each capable of predicting: a flow parameter, a well parameter, and/or the status of the at least one control point, resulting from: the hypothetical change in the status of the at least one control point, and/or the hypothetical change in a well parameter, and/or the hypothetical change in a flow parameter, for each respective production well.

15. A method of estimating a flow parameter, and/or a well parameter, and/or status of at least one control point, for a hydrocarbon production well, the method comprising:

operating a computer system in accordance with claim 1; and determining an estimated flow parameter, and/or well parameter, and/or status of at least one control point, for the hydrocarbon production well, by inputting to the first well model one or more states of the production well, each of the one or more states comprising:

a flow parameter, and/or a well parameter, and/or an associated status of at least one control point of the production well.

16. The method of claim 1, wherein the first well model forms part of a statistical approach such that: a flow parameter, a well parameter, and/or a status of the at least one control point, is output by the first well model as a probability distribution with an associated degree of uncertainty.

17. The method of claim 1, wherein h the control point comprises:

a flow control valve; a pump; a compressor; a gas lift injector; an expansion devices; a choke control valve; gas lift valve settings or rates on wells or riser pipelines; ESP (Electric submersible pump) settings, effect, speed or pressure lift; down hole branch valve settings, down hole inflow control valve settings; or topside and subsea control settings on one or more: separators, compressors, pumps, scrubbers, condensers/coolers, heaters, stripper columns, mixers, splitters, chillers; and wherein the flow parameters include one or more of: pressures; flow rate, a gas flow rate, an oil flow rate, a water flow rate a liquid flow rate, a hydrocarbon flow rate, a flow rated that is the sum of one or more of any of the previous rates (by volume, mass or flow speed); an oil fraction, a gas fraction, a carbon dioxide fraction, a multiphase fluid fraction, a hydrogen sulphide fraction, a multiphase fluid fraction, temperatures, a ratio of gas to liquid, densities, viscosities, molar weights, pH, water cut (WC), productivity index (PI), Gas Oil Ratio (GOR), BHP and wellhead pressures, rates after topside separation, separator pressure, other line pressures, flow velocities or sand production; and wherein the well parameters include one or more of: depth, length, number and type of joints, inclination, cross-sectional area (e.g. diameter or radius) within/of a production well, wellbore, well branch, pipe, pipeline or sections thereof; choke valve Cv-curve; choke valve discharge hole cross-sectional area; heat transfer coefficient (U-value); coefficients of friction; material types; isolation types; skin factors; and external temperature profiles.

18. The method of claim 1, wherein the set of first well model parameters parameterises the properties common to all of the first plurality of production wells with a first accuracy, the method comprising the further steps of:

training the first well model on data relating to flow parameters, well parameters, and/or an associated status of the at least one control point, from at least two production wells;

obtaining an updated set of first well model parameters from the training of the first well model, wherein the updated set of first well model parameters parameterise the properties common to all of the first plurality of production wells with a second accuracy that is greater than the first accuracy; and updating the first well model based on the updated set of first well model parameters, wherein the updated first well model allows for a more accurate modelling of any one of the plurality of production wells.

19. The method of claim 18, wherein said step of training the first well model comprises a plurality of iterative training steps.

20. The method of claim 18, comprising:

introducing at least one additional well into the first plurality of production wells;

retraining the first well model on data relating to: flow parameters, and/or well parameters, and/or an associated status of at least one control point, from the at least one additional well;

obtaining a re-updated set of first well model parameters from the retraining of the first well model, wherein the re-updated set of first well model parameters parameterise the common properties of the first plurality of production wells with an accuracy that is greater than the second accuracy; and updating the first well model based on the re-updated set of first well model parameters.

21. The method of claim 18, comprising:

obtaining additional data relating to: flow parameters, and/or well parameters, and/or an associated status of the at least one control point, from at least one of the first plurality of production wells;

retraining the first well model on the additional data;

obtaining a re-updated set of first well model parameters from the retraining of the first well model, wherein the re-updated set of first well model parameters parameterise the common properties of the first plurality of production wells with an accuracy that is greater than the second accuracy; and updating the first well model based on the re-updated set of first well model parameters.

22. A method according to claim 18, comprising:

prior to said step of training the first well model, inputting a second well model into the first well model, wherein the second well model models: flow parameters, and/or well parameters, and/or an associated status of the at least one control point, for only one production well which the second well model relates to, and wherein the second well model is parameterised by a set of second well model parameters that are representative of properties that are specific to the production well to which the second well model relates, wherein the set of second well model parameters parameterises the properties specific to the production well with a third accuracy;

during said step of training the first well model, obtaining an updated set of second well model parameters for the second well model relating to the production well, wherein the updated set of second well model parameters parameterise the properties specific to the production well which the second well model relates to with an accuracy that is greater than the third accuracy; and updating the second well model based on the updated set of second well model parameters.

23. A computer system for modelling an individual hydrocarbon production well of a plurality of hydrocarbon production wells, wherein the computer system comprises an interface for receiving data relating to: flow parameters, and/or well parameters, and/or an associated status of at least one control point, from each of a plurality of hydrocarbon production wells, and wherein the computer system comprises stored instructions that, when executed by the computer system, cause the computer system to perform the method of claim 1.

24. A non-transitory computer-readable storage medium comprising instructions for execution on a computer system arranged to receive data relating to: flow parameters, and/or well parameters, and/or an associated status of at least one control point, from each of a plurality of production wells; wherein the instructions, when executed, will configure the computer system to carry out the method of claim 1.

25. The method of claim 1, comprising:

generating, using data-driven modelling, a second well model that models: flow parameters, and/or well parameters, and/or an associated status of at least one control point, for only one production well, wherein the second well model is parameterised by a set of second well model parameters that are representative of properties that are specific to the production well to which the second well model relates; and combining the second well model with the first well model to form a combined well model that models: flow parameters, and/or well parameters, and/or an associated status of the at least one control point, for only the one production well.

26. The method of claim 25, wherein the one well to which the second well model relates is comprised within the first plurality of production wells.

27. The method of claim 25, comprising:

generating, using data-driven modelling, a plurality of second well models, each second well model modelling: flow parameters, and/or well parameters, and/or an associated status of at least one control point, for a respective production well, each second well model being parameterised by a set of second well model parameters that are representative of properties that are specific to the production well to which the second well model relates; and combining each second well model with the first well model to form combined well models that each model: flow parameters, and/or well parameters, and/or an associated status of at least one control point, for the respective production well to which the combined well model relates.

28. The method of claim 1, wherein the first data-driven well model is a machine-learning well model.

29. The method of claim 1, wherein the set of first well model parameters comprises more than 1,000 model parameters each representative of a property common to all of the first plurality of production wells.

30. The method of claim 1, wherein the first data-driven well model comprises a neural network.

31. The method of claim 1, wherein generating the first data-driven well model comprises training the first data-driven well model using a stochastic gradient descent method.

32. A method of generating an estimation or a prediction for a hydrocarbon production well, the method comprising:

generating a first model in accordance with claim 1; and inputting data from the hydrocarbon production well to the first model to generate an estimation or a prediction for the hydrocarbon production well.

* * * * *